US007152655B2

(12) United States Patent
Clauss

(10) Patent No.: US 7,152,655 B2
(45) Date of Patent: Dec. 26, 2006

(54) FLAT STRUCTURE

(76) Inventor: Ulrich Clauss, Rauberweg 3, 73266, Bissingen (DE)

( * ) Notice: Subject to any disclaimer, the term of this patent is extended or adjusted under 35 U.S.C. 154(b) by 0 days.

(21) Appl. No.: 10/486,782

(22) PCT Filed: Aug. 7, 2002

(86) PCT No.: PCT/EP02/08830

§ 371 (c)(1),
(2), (4) Date: Sep. 27, 2004

(87) PCT Pub. No.: WO03/014513

PCT Pub. Date: Feb. 20, 2003

(65) Prior Publication Data

US 2005/0022945 A1 Feb. 3, 2005

(30) Foreign Application Priority Data

Aug. 10, 2001 (DE) ..... 101 39 583
Dec. 12, 2001 (DE) ..... 101 61 159

(51) Int. Cl.
*E06B 9/15* (2006.01)

(52) U.S. Cl. ..... 160/133; 160/231.1

(58) Field of Classification Search ..... 160/133, 160/231.1, 231.2; 52/664, 665, 669, 456
See application file for complete search history.

(56) References Cited

U.S. PATENT DOCUMENTS 1,247,599 A * 11/1917 Hough ..... 160/219
1,612,771 A * 12/1926 Pfeiffer ..... 52/669
2,042,002 A * 5/1936 Hovey ..... 160/133
3,586,091 A * 6/1971 Roberts ..... 160/231.2
4,574,861 A * 3/1986 Mao ..... 160/133

FOREIGN PATENT DOCUMENTS

NL 106341 10/1963

* cited by examiner

*Primary Examiner*—David Purol
(74) *Attorney, Agent, or Firm*—Leydig, Voit & Mayer, Ltd.

(57) ABSTRACT

A flat article (4) comprises bars (6) extending parallel to one another in spaced-apart fashion, which are joined together by connecting means (7). The connecting means (7) can be designed such that they extend over the full length of the flat article (4), or alternatively they can each join together only two immediately adjacent bars (6).

31 Claims, 17 Drawing Sheets

FLAT STRUCTURE

The present invention relates generally to window shades, wall hangings, and the like and more particularly, to an apparatus of such type which has a plurality of parallel light deflecting slats which when hung form a flat article.

BACKGROUND OF THE INVENTION

For regulating the light that enters through windows, it is known to use slatted shades. A slatted shade comprises many individual slats extending parallel to one another and as a rule horizontally. The slats are curved cylindrically about an axis extending parallel to the slat axis in order to provide adequate stability against kinking. The individual slats are kept spaced apart, creating a light gap between adjacent slats. The spacers for the slats are structures similar to a rope ladder, on the rungs of which the slats rest. With the aid of two tapes extending through all the slats, the length of the thus-formed slatted rollup shade can be varied. The entry of light also can be varied by means of positioning the slats more or less obliquely.

It is also known to vary the acoustical properties in a room and the appearance of the room with the aid of wall coverings and ceiling coverings.

OBJECTS AND SUMMARY OF THE INVENTION

The object of the invention is to create a multi-purpose novel flat article. In a further aspect of the invention, a flat article is provided in which the passage of light through it, observed from reflection, is further reduced.

In carrying out the invention, a novel flat article is provided that comprises plurality of bars extending parallel to one another, which are joined together by connecting means, specifically in such a way that at least in the position for use, a gap is produced between each two adjacent bars. The connecting means furthermore make flexibility of the flat article possible about axes that extend parallel to the bars.

The novel flat article can not only be used for window shades, awnings and the like, that is, to regulate the passage of light through them, but also for wall coverings or ceiling coverings, and particularly for varying the acoustics of a room. Because of the gaps between the bars, the sound absorption in the room can be varied.

To join the individual bars to one another, various alternative connecting means can be used. The connecting means can be formed by at least two connecting elements that are at least approximately linear or bandlike, and the individual bars are joined together in a way to make the flat article. The linear connecting means can either pass through openings in the bars or extend over circumferential surfaces of the bars and be connected to the outer circumferential surface. The latter option is possible if there are two linear elements per connecting point which are twisted together in the region of the gap are used. The other kind of connecting means resides in the use of individual members that each join together only two bars. Their shape depends on the type of bars involved.

The bars of the flat article are preferably predominantly hollow in order to minimize weight.

Depending on the intended use, it is expedient if the bars have a constant cross section over their length. The bars can have the shape of tubes that are completely closed in the circumferential direction, or they can be tubelike articles with a gap extending lengthwise on one side. Using the gap makes production substantially simpler. In the case of individual connecting elements, they can be provided with a shank and a head, with the head resting on the edges of the slit and the shank extending to the outside through the gap. At an appropriate spacing, the shank into a corresponding opening in the adjacent bar and is anchored in that opening. The simplest form of anchoring is to bend the shank over 90° in the next bar.

Insertable individual connecting elements can simplify assembly. The linear connecting element need only be threaded through one hole, while on the opposite side of the tubular bar it can emerge through the gap.

The bars of the flat article preferably are produced by roll forming, by means of which bars with a longitudinal slit in particular can be easily produced in endless form.

The bars expediently comprise a material that does not oxidize in the particular environment in use, such as aluminum or special steel, preferably with a satin-finished surface. The wall thickness of the bars in window shade applications is between 0.1 and 0.5 mm, and preferably between 0.2 and 0.4 mm. The latter range is a good comprise between weight, deformability in the roll forming, and stability in later use. Plastic can also be used. The joining technique in each case depends on the material as well as the weight and the resultant force that may occur at the most heavily loaded point.

If the flat article is used to control the entry of light, the bars preferably have a substantially elliptical or kidney-shaped form in such case, even when the sun is low in the sky, good shading still is possible without the bars having to be placed too close together. The diameter of the bars can be between 2 mm and 15 mm, preferably between 2 and 5 mm. The spacing range preferably is between 0.5 and 5 mm, and the wall thickness of the bars is between 0.1 mm and 0.5 mm. The bars may be straight so they can be rolled up onto a winding roller, but alternatively can be curved.

Securing means prevent the bars from being displaceable counter to one another in the longitudinal direction.

To keep the bars spaced apart, spacer elements in the form of short tubular portions can be used, or the spacer elements can be an integral component of the bars or of the connecting elements. In the case of a linear connecting element of spring steel wire, the steel wire can be bent in zigzag fashion, with one bar disposed at each sharp bend.

The linear connecting means can be monofilaments of plastic or metal and preferably spring steel. The connecting elements preferably should be UV-resistant and should also not oxidize.

The spacing between the bars can be constant over the width of the flat article, that is, in the direction transverse to the length, or it can vary in that direction. The variation can be intermittent or continuous.

Depending on the geometry of the individual bars, on the side of the flat article remote from the light source a very brightly lighted, almost glaringly bright strip can be observed, which has the width of the light source and spreads over the entire vertical or horizontal extent of the flat article. The direction of propagation of the bright strip depends on whether the bars are disposed horizontally or vertically. With horizontal bars, a vertical strip results.

In the flat article of the invention, the bars form a circumferentially closed tube. The bars all have the same cross-sectional profile. By design, each bar forms a continuous groove on its outside, that is, on the side facing away from the light source. The groove points upward at an angle of approximately 26° relative to a plane defined by the deployed flat article.

Because of this groove, incident light is reflected toward the underside of the bar above it at an angle such that no reflection occurs, and the light is cast onto the other side of the flat article.

Especially favorable conditions result if the groove is defined by two substantially flat faces which form an angle of between 165° and 120° with one another, preferably an angle of 137°. In this case, the direction of the groove means that the bisector of the angle between the two faces that define the groove extends at an angle of approximately 26° to a plane that is defined by the deployed flat article. Especially favorable reflection conditions, that is, the least possible passage of light through, result if the cross-sectional profile is pentagonal.

With the pentagonal cross-sectional profile, two edges of the cross-sectional profile can extend parallel to one another.

An edge extending between the edges parallel to one another forms an angle of 86° with the longer of the two parallel edges. When the flat article is deployed, this means that the underside of the applicable bar is no longer perpendicular to the plane or the two-dimensional outline defined by the deployed flat article. The orientation is selected such that the front edge of the bar is toward the light source and somewhat higher than the edge of the bar that faces away from the light source.

Production becomes especially simple if the bar is edge-rolled from a sheet-metal strip. The rolled profile can be formed embodied as overlapping one side. This has the advantage on the one hand of an improved appearance, and on the other, given a suitable location of the overlap, a defined sharp edge is created in the region of the underside of the applicable bar, and hence more-favorable conditions when light shines through, or in other words better shading action.

To hold the bars firmly to the connecting elements, laser welding also can be used, which is relatively simple in production because it makes threading or insertion operations unnecessary. The pentagonal profile is quite suitable for laser welding because a plane face is already available.

Other objects and advantages of the invention will become apparent upon reading the following detailed description and upon reference to the drawings, in which:

Figure 1:
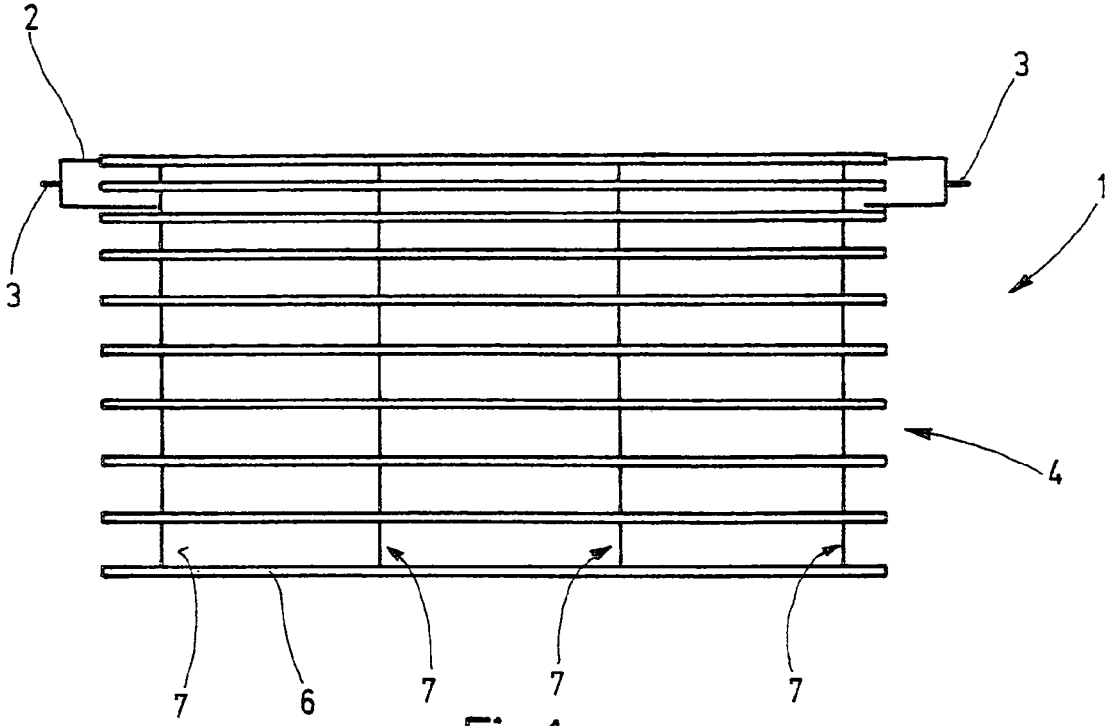
FIG. 1 is a side elevational view of a window shade having a flat article or window shade body in accordance with the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Referring now more particularly to FIG. 1 of the drawings, there is schematically shown an illustrative window shade 1 in accordance with the invention. The window shade 1 has a winding roller 2, which is fixed in a manner capable of rotation in a suitable wall mounting, and a shade body 4 is secured by one edge to the winding roller 2. The shade body 4 comprises a textile flat article 5, as shown schematically in FIG. 2. The flat article 5 includes a plurality of bars 6 extending parallel to one another, which extend across the width of the flat article 5 and are spaced apart from one another. The spacing between the bars is approximately the same size as the diameter of each bar 6.

Each bar 6 in this case comprises a circular steel tube which is circumferentially closed. Viewed over their length, the bars 6 have a constant cross section. Instead of a steel tube, a plastic or drawn aluminum tube may be used as will be shown hereinafter. It also is possible to produce the bars 6 by roll-forming. Brass or bronze can also be used as the material.

The surface of the bars 6 can be satin-finished or shiny, depending on the visual effect to be attained.

To keep the bars 6 spaced apart in the flat article 5 and secure them to one another, connecting means 7 are provided. Each of the connecting means 7 comprises a connecting element 8, in the form of a steel wire, for instance, of small diameter. For receiving the connecting element 8, which to use weaving terminology is equivalent to a warp thread, each bar 6 is provided at the applicable point with bores 9 aligned with one another. The axes of the bores 9 are perpendicular to the longitudinal axis of the bars 6 and pass through the respective bar 6 across the diameter of the bars 6.

Since when the flat article 5 is deployed the connecting elements 8 are located in the same plane, all the bores of the bars 6 are oriented identically as well; that is, the bores 9 in each bar 6 are axially parallel. The connecting element 8, in the form of the steel wire, extends uncut successively through all the bars 6; that is, the connecting element 8 extends over the entire length of the flat article 5. The bar 6 at the lower edge of the flat article 5 is anchored to the connecting element 8 in a suitable way, for instance by welding, adhesive bonding, or deformation.

So that the bars 6 will always maintain the desired spacing from one another, a spacer sleeve 11 is threaded onto each connecting element 8 between each two adjacent bars. The spacer sleeves 11 all have the same dimensions, and as a result, the parallel bars 6 are kept spaced apart with the same spacing from one another in the longitudinal direction of the flat article 5, namely in the vertical direction as viewed in FIG. 1. In this way, the desired gaps between the bars 6 are achieved.

The diameter of the bars 6 and the size of the gap between them can be adapted to the particular use. The diameter of the base preferably is between 2 and 15 mm, most preferably between 2 and 5 mm, and the spacing between the bars preferably is on the same order of magnitude. The wall thickness of the bars preferably is from 0.1 to 0.5 mm, and most preferably from 0.2 to 0.4 mm.

Figure 4:
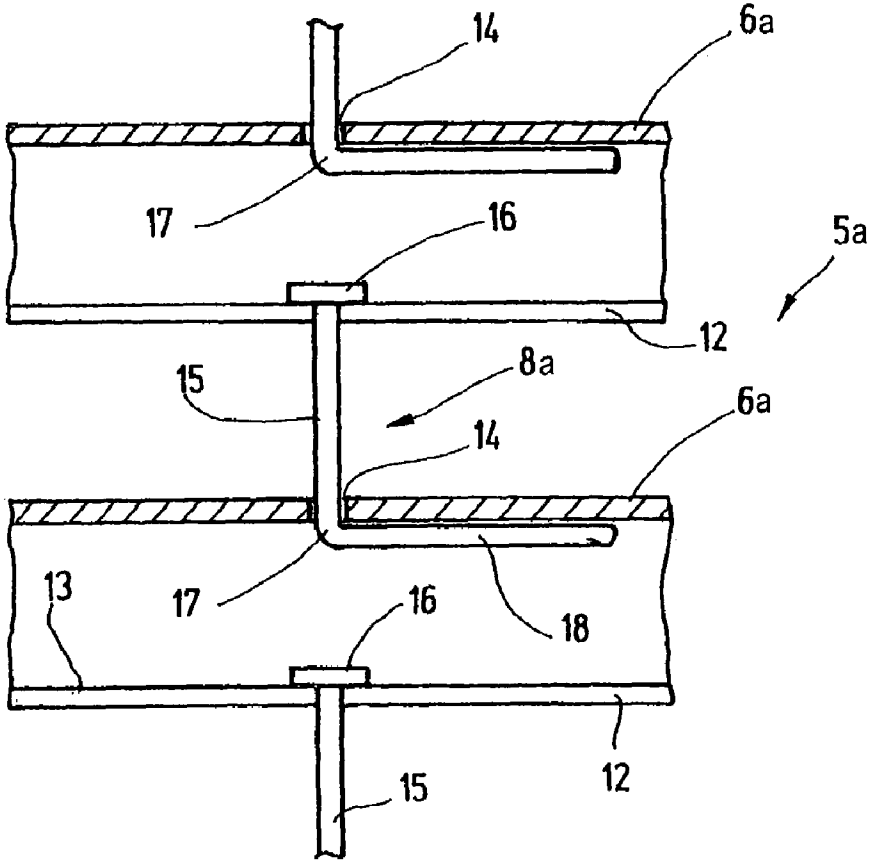
FIGS. 3 and 4, are longitudinal and transverse sections, respectively, of another embodiment of the flat article according to the invention.
Figure 3:
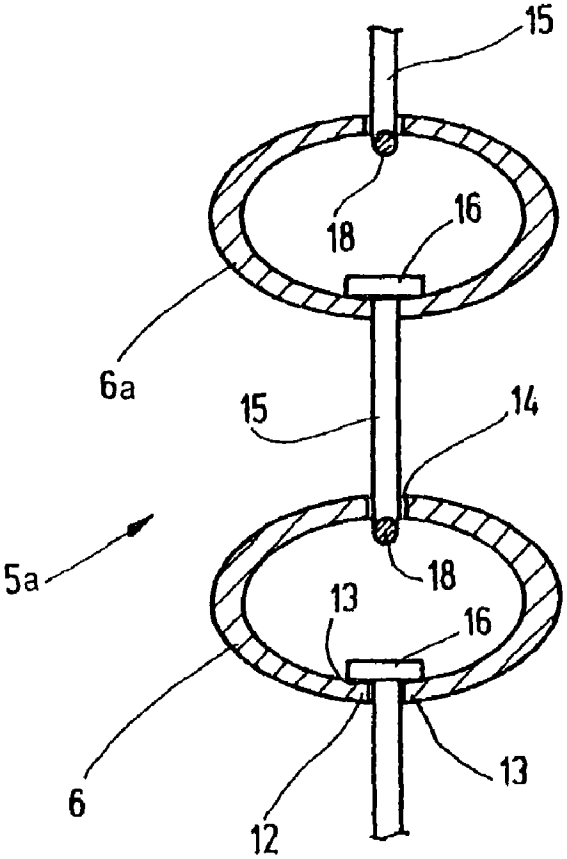

In FIGS. 3 and 4, another version of a flat article $\mathbf{5}_a$ is shown. Here, each bar $\mathbf{6}_a$ comprises a sheet-metal strip of steel roll-formed into a tube. The cross section of the bar $\mathbf{6}_a$ is approximately elliptical or oval. The tube produced by roll forming is not closed on the circumference but instead, on one side with a lesser radius of curvature, has a slit 12 extending over the length and defined by two slit edges 13. The slit edges 13 extend parallel with constant spacing over the length of the bar $\mathbf{6}_a$ and are located at the same height. On the side diametrically opposite the slit 12, each bar is formed with a row of holes 14, which correspond in number to the number of desired connecting elements.

On the side diametrically opposite the slit 12, each bar is formed with a row of holes 14, which correspond in number to the number of desired connecting elements.

Figure 2:
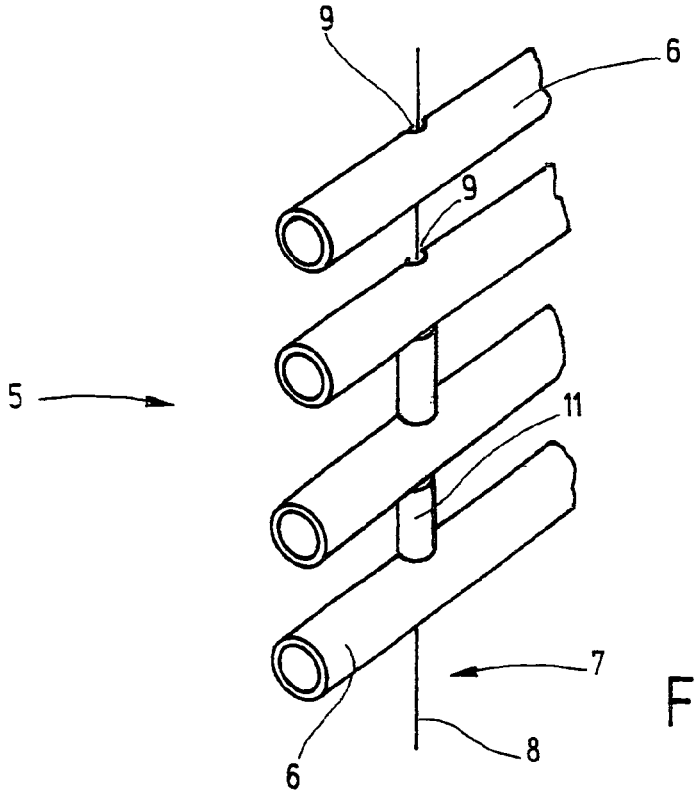
FIG. 2 is a fragmentary perspective of the flat article shown in FIG. 1.

While in the exemplary embodiment of FIG. 2 the connecting elements 8, each in the form of a steel wire, extend through the full length of the flat article 5 and are anchored in this way to all the bars 6, in the embodiment of FIGS. 3 and 4 connecting elements $\mathbf{8}_a$ each couple only two adjacent bars $\mathbf{6}_a$ to one another. Each connecting element $\mathbf{8}_a$ is in the form of a "nail" and comprises a wirelike shank 15 which is provided with a head 16 on one end. At a point remote from the head 16, the shank 15 is bent over at a right angle at 17 so that a longer portion 18 of the shank 15 extends in the direction parallel to the longitudinal axis of the bar $\mathbf{6}_a$. The length of the portion 18 is greater than the inside diameter of the bar 6. For instance, the portion 14 has a length equivalent to approximately two to three times the diameter of the bar 6.

Each connecting element 8 is in the form of a "nail" and comprises a wirelike shank 15 which is provided with a head 16 on one end. At a point remote from the head 16, the shank 15 is bent over at a right angle at 17 so that a longer portion 18 of the shank 15 extends in the direction parallel to the longitudinal axis of the bar 6. The length of the portion 18 is greater than the inside diameter of the bar 6. For instance, the portion 14 has a length equivalent to approximately two to three times the diameter of the bar 6.

As the drawings show, when the flat article $\mathbf{5}_a$ is suspended, the head 16 rests on the side of the two slit edges 13 oriented toward the interior, while the bent portion 18 rests against the inside of the bar on the side opposite the slit 12.

One connecting element $\mathbf{8}_a$ is inserted into each hole 14, with the bent portion 18 leading. Although the portion 18 is larger than the diameter of the bar 6, there is no hindrance to the insertion process. During assembly, the portion 18 can protrude freely through the slit 12 on the opposite side, so that the connecting element $\mathbf{8}_a$ can be inserted far enough that the bending point 17 is located in the hole 14. Next, the connecting element $\mathbf{8}_a$ is rotated 90° until the portion of the shank 15 with the head 16 on it protrudes perpendicularly away from the bar $\mathbf{6}_a$. For further assembly, a filler piece can be thrust temporarily into the applicable bar $\mathbf{6}_a$, and by means of it the bent portion 18 is firmly held in contact with the inside of the bar 6. The filler piece can be in bar form and therefore can be introduced easily because all the connecting elements $\mathbf{8}_a$ are inserted into the applicable bar $\mathbf{6}_a$ with the same orientation of the bent portion 18. Next, the bar $\mathbf{6}_a$ prepared in this way is connected to a further bar $\mathbf{6}_a$; the connecting elements $\mathbf{8}_a$ are introduced from the side into the slit 12 of this further bar $\mathbf{6}_a$, with their head 16 located in the interior of the applicable bar $\mathbf{6}_a$. Next, the filler piece, which serves to fix the portions 18 temporarily, is pulled out again. The process described above is repeated until such time as the flat article $\mathbf{5}_a$ has achieved the desired length.

During assembly, the portion 18 can protrude freely through the slit 12 on the opposite side, so that the connecting element 8 can be inserted far enough that the bending point 17 is located in the hole 14. Next, the connecting element 8 is rotated 90° until the portion of the shank 15 with the head 16 on it protrudes perpendicularly away from the bar 6. For further assembly, a filler piece can be thrust temporarily into the applicable bar 6, and by means of it the bent portion 18 is firmly held in contact with the inside of the bar 6. The filler piece can be in bar form and therefore can be introduced easily because all the connecting elements 8 are inserted into the applicable bar 6 with the same orientation of the bent portion 18. Next, the bar 6 prepared in this way is connected to a further bar 6; the connecting elements 8 are introduced from the side into the slit 12 of this further bar 6, with their head 16 located in the interior of the applicable bar 6. Next, the filler piece, which serves to fix the portions 18 temporarily, is pulled out again.

The process described above is repeated until such time as the flat article 5 has achieved the desired length.

For laterally locking the bars together, a suitable end piece can be inserted into each of the bars $\mathbf{6}_a$. The end piece prevents the head 16 of the connecting element 8 on the end from being able to slip out of the associated bar $\mathbf{6}_a$.

Figure 5:
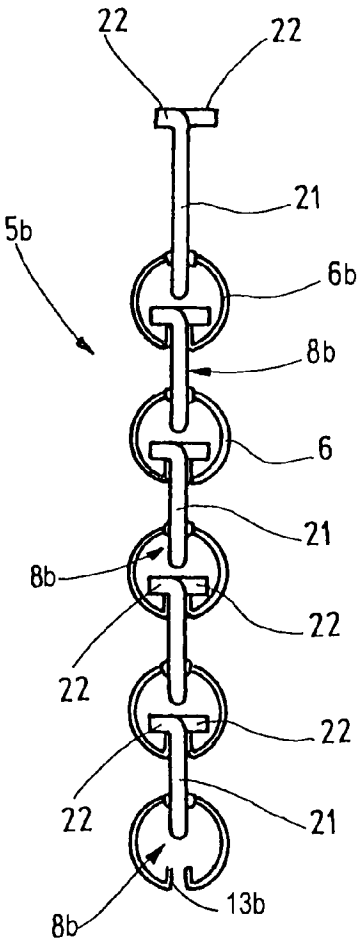

FIGS. 1 and 2 show a flat article 5 in which the connecting elements 8 do not have the shape of a bent "nail" as in the exemplary embodiment of FIGS. 3 and 5 but instead are in the shape of a U.

Figure 6:
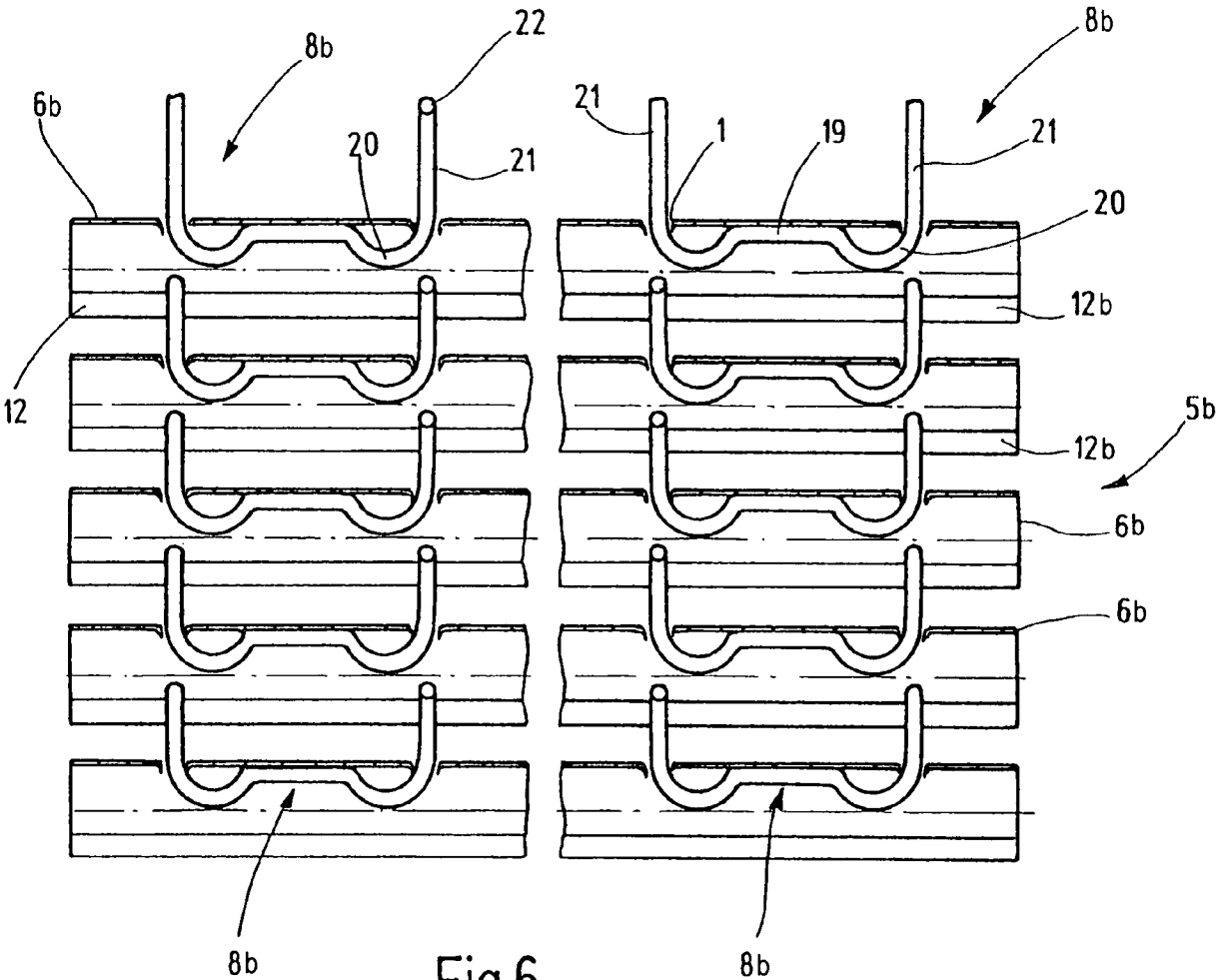
FIGS. 5 and 6, are longitudinal and transverse sections, respectively, of a further embodiment of a flat article according to the invention.

Each connecting element $\mathbf{8}_b$, as depicted in FIGS. 5 and 6, comprises a bent wire portion, which forms a back 19. On both ends, the back 19 merges with two curves 20, which are oriented away from the open side of the U-shaped connecting element, as shown.

Adjoining the curves 20, the back 19 merges with two legs 21 axially parallel to one another, which as FIG. 5 shows, are bent toward opposite sides on their free ends. This creates extensions 22 which project laterally and are located at the same height, and in which the spacing of the free ends from one another is approximately equivalent to the inside diameter of each bar $\mathbf{6}_b$.

The legs 21, in the exemplary embodiment of FIG. 6, extend through corresponding adjacent openings in the side of each bar $\mathbf{6}_b$ opposite the slit $\mathbf{12}_b$. As can be seen, the curves 20 have the purpose of enabling a defined contact of the straight part of the back 19 with the inside of the bar $\mathbf{6}_b$, without this contact being hindered by the curvatures at the transition between the back 19 and the legs 21.

As can be seen, the curves 20 have the purpose of enabling a defined contact of the straight part of the back 19 with the inside of the bar 6, without this contact being hindered by the curvatures at the transition between the back 19 and the legs 21.

In a departure from the exemplary embodiment of FIGS. 3 and 4, in the bars $\mathbf{6}_b$ in the exemplary embodiment of FIGS. 5 and 6, the two edges $\mathbf{13}_b$ of the slit are bent upward toward the interior of the application bar $\mathbf{6}_b$, and as a result the extensions 22 extend farther into the interior of the application bar $\mathbf{6}_b$. The production of the flat article 5 of FIGS. 5 and 6 is done as follows:

First, the U-shaped connecting element $\mathbf{8}_b$ is held in readiness; the legs 21 still extend all the way and do not have extensions 22 bent at an angle. The connecting elements $\mathbf{8}_b$ thus furnished are introduced through the slit $\mathbf{12}_b$ by their legs 21 into the respective openings 14. After the legs 21 have been inserted, they are bent at an angle to opposite sides on each connecting element $\mathbf{8}_b$, creating the opposed extensions 22 bent at an angle. Once the applicable bar $\mathbf{6}_b$ has been equipped completely with the desired number of connecting elements $\mathbf{8}_b$, and these connecting elements have also been bent over as shown, the legs 21 are introduced from the side into the applicable slit $\mathbf{12}_b$ of the next bar $\mathbf{6}_b$. The result is a configuration as depicted in FIG. 5.

Figure 7:
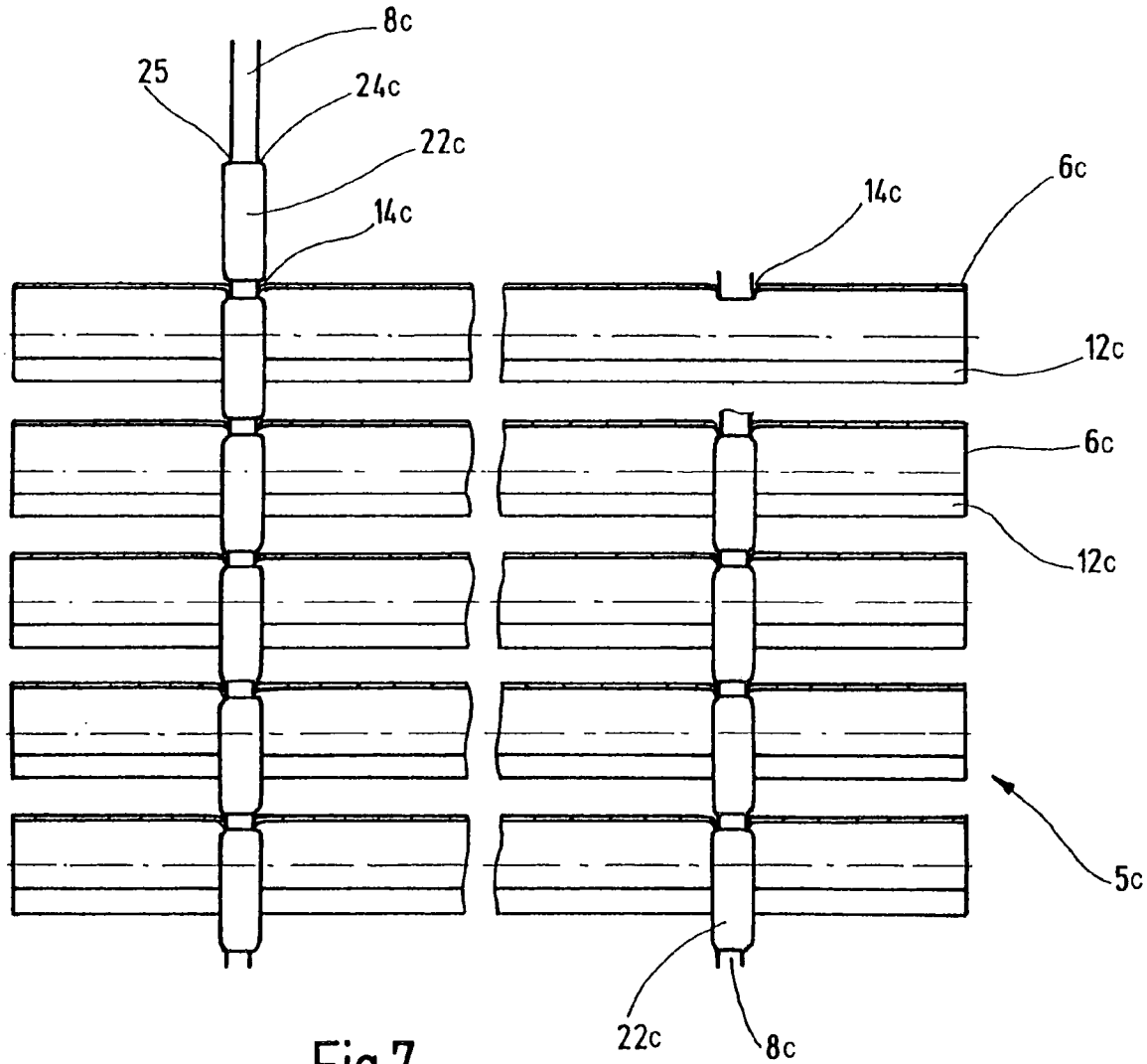
FIG. 7 is a longitudinal section of another embodiment of window shade flat article according to the invention with deformed wirelike connecting means.

FIG. 7 shows an embodiment in which connecting elements $\mathbf{8}_c$ again pass endlessly through the full length of the flat article $\mathbf{5}_c$. The bars $\mathbf{6}_c$ have the shape explained in conjunction with FIG. 6, except that for each connecting element $\mathbf{8}_c$, only one opening $\mathbf{14}_c$ is provided. Similarly to the exemplary embodiment of FIG. 2, the connecting element $\mathbf{8}_c$ comprises a spring steel wire that is passed through. In the region of the opening $\mathbf{14}_c$, the spring steel wire has its original circular shape, while adjacent to that it is pressed flat, creating a flattened portion $\mathbf{22}_c$. The length of the flattened portion $\mathbf{22}_c$, viewed in the longitudinal direction of the connecting element 8, defines the spacing of adjacent bars $\mathbf{6}_c$ from one another.

The production of this embodiment is as follows:

From the free end, a bar is positioned onto the applicable connecting element. In this process the connecting element $\mathbf{8}_c$ first passes through the slit $\mathbf{12}_c$ and then through the opening $\mathbf{14}_c$. After this assembly is completed, the wirelike connecting element $\mathbf{8}_c$, which can also be considered linear, is pressed flat, specifically in such a way that the longitudinal extent of the pressed-flat portion $\mathbf{22}_c$ is located parallel to the slit $\mathbf{12}_c$. This creates an enlargement in width that creates two shoulders 24 and 25. When the next bar $\mathbf{6}_c$ is then positioned onto the connecting element $\mathbf{8}_c$, the slit $\mathbf{12}_c$ can readily pass over the widened portion $\mathbf{22}_c$, while the opening $\mathbf{14}_c$ will stand with its edges on the two shoulders 24 and 25.

Finally, a configuration is obtained as depicted in FIG. 7, in which each bar, with its inner edges of the holes, rests on the shoulders 24 and 25 of each flattened portion $\mathbf{22}_c$. The flattened portion $\mathbf{22}_c$ is located essentially inside each bar $\mathbf{6}_c$.

If the length of the portion $\mathbf{22}_c$, as viewed in the longitudinal direction of the connecting element $\mathbf{8}_c$, protrudes out of the bar $\mathbf{6}_c$, as shown, and the spacing between adjacent flattened portions $\mathbf{22}_c$ is approximately equivalent to the thickness of the material comprising the bar $\mathbf{16}_c$ in the region of the hole $\mathbf{14}_c$, the spacing between adjacent bars $\mathbf{6}_c$ is largely fixed. This arrangement furthermore has the advantage that each bar $\mathbf{6}_c$ is individually coupled to the applicable connecting element $\mathbf{8}_c$. In a suspended arrangement, the lowermost bar $\mathbf{6}_c$ need not support the weight of everything above it, in the way that is required for instance in the exemplary embodiment of FIG. 2, nor must it receive the full weight of the uppermost bar $\mathbf{6}_c$ in a suspended arrangement, as in the exemplary embodiment of FIGS. 4 and 6.

This arrangement furthermore has the advantage that each bar 6 is individually coupled to the applicable connecting element 8. In a suspended arrangement, the lowermost bar 6 need not support the weight of everything above it, in the way that is required for instance in the exemplary embodiment of FIG. 2, nor must it receive the full weight of the uppermost bar 6 in a suspended arrangement, as in the exemplary embodiment of FIGS. 4 and 6.

Figure 8:
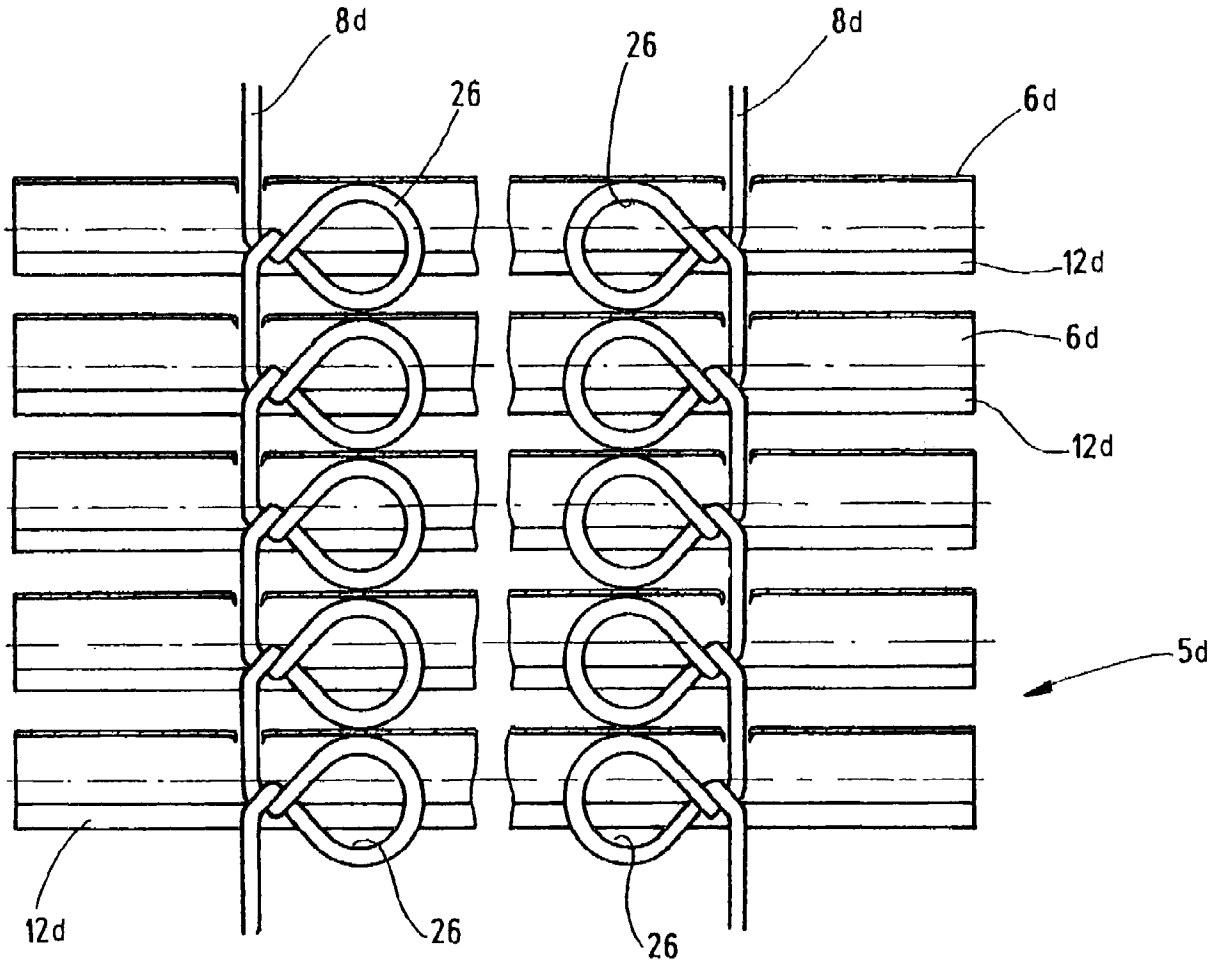
FIG. 8 is a longitudinal section of a further embodiment of window shade flat article according to the invention with connecting means twisted into loops.

FIG. 8 shows an embodiment in which once again connecting elements $\mathbf{8}_d$ extend through the full length of the flat article $\mathbf{5}_d$. Between each two adjacent bars $\mathbf{6}_d$, the wirelike connecting element $\mathbf{8}_d$ is twisted into a loop 26. The diameter of the loop 26 can be less than the diameter of the bars $\mathbf{6}_d$.

The spacing that the loops 26 have from one another defines the spacing of the bars, in a suspended arrangement. If the diameter of the loops 26 is enough, and adjacent loops 26 nearly touch one another, the flat article $\mathbf{5}_d$ cannot be folded up all the way. In every case, a corresponding gap remains between adjacent bars $\mathbf{6}_d$.

The production of the flat article $\mathbf{5}_d$ of FIG. 8 is similar to the production of the flat article of FIG. 7, except that instead of being pressed flat, the connecting element $\mathbf{8}_d$ is twisted into a loop, which is then pulled through the slit $\mathbf{12}_d$, as shown, into the interior of the bar $\mathbf{6}_d$.

Figure 9:
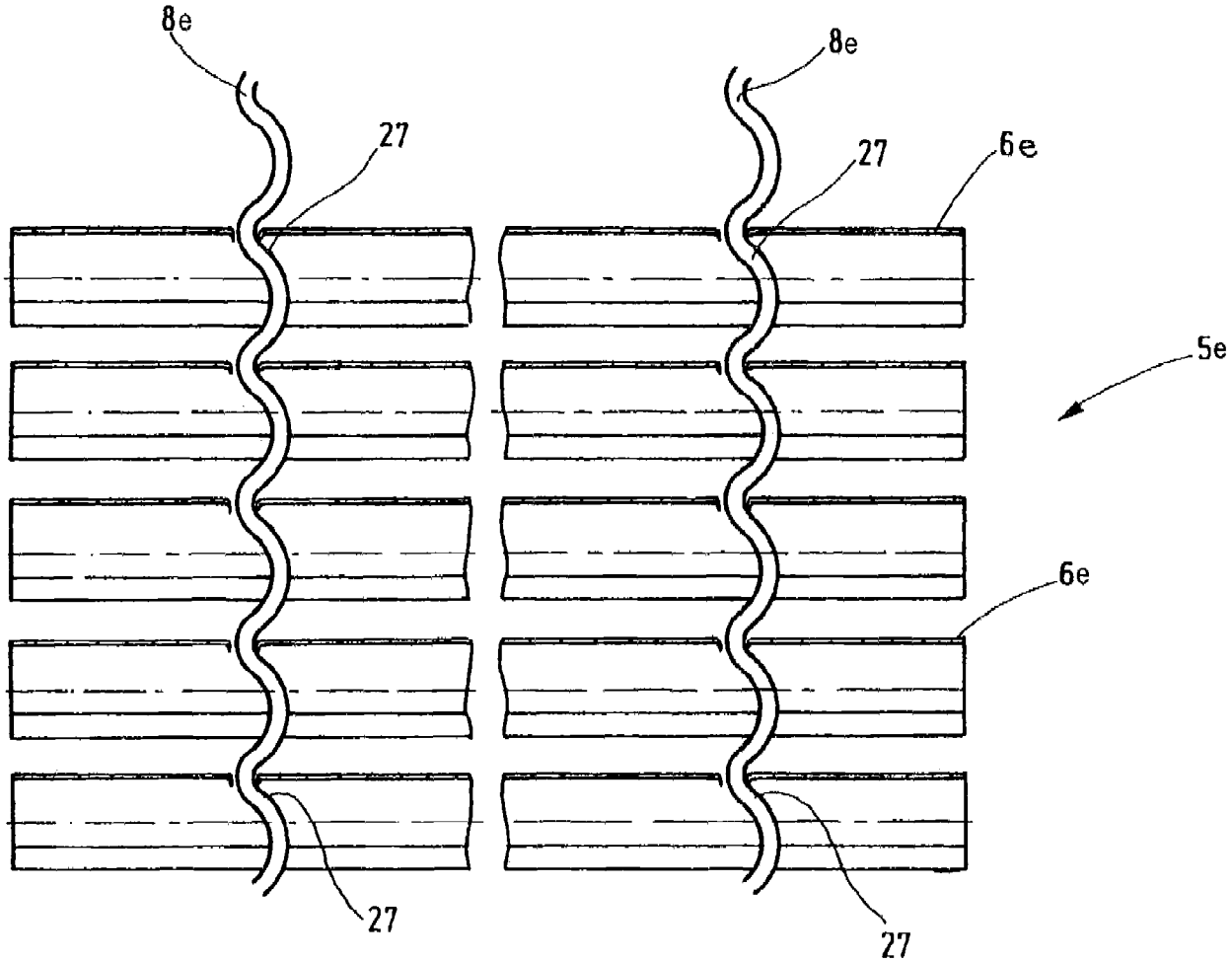
FIGS. 9 & 10 are longitudinal sections of alternative embodiments of window shade flat articles according to the invention with undulating and zigzag connecting elements.
Figure 10:
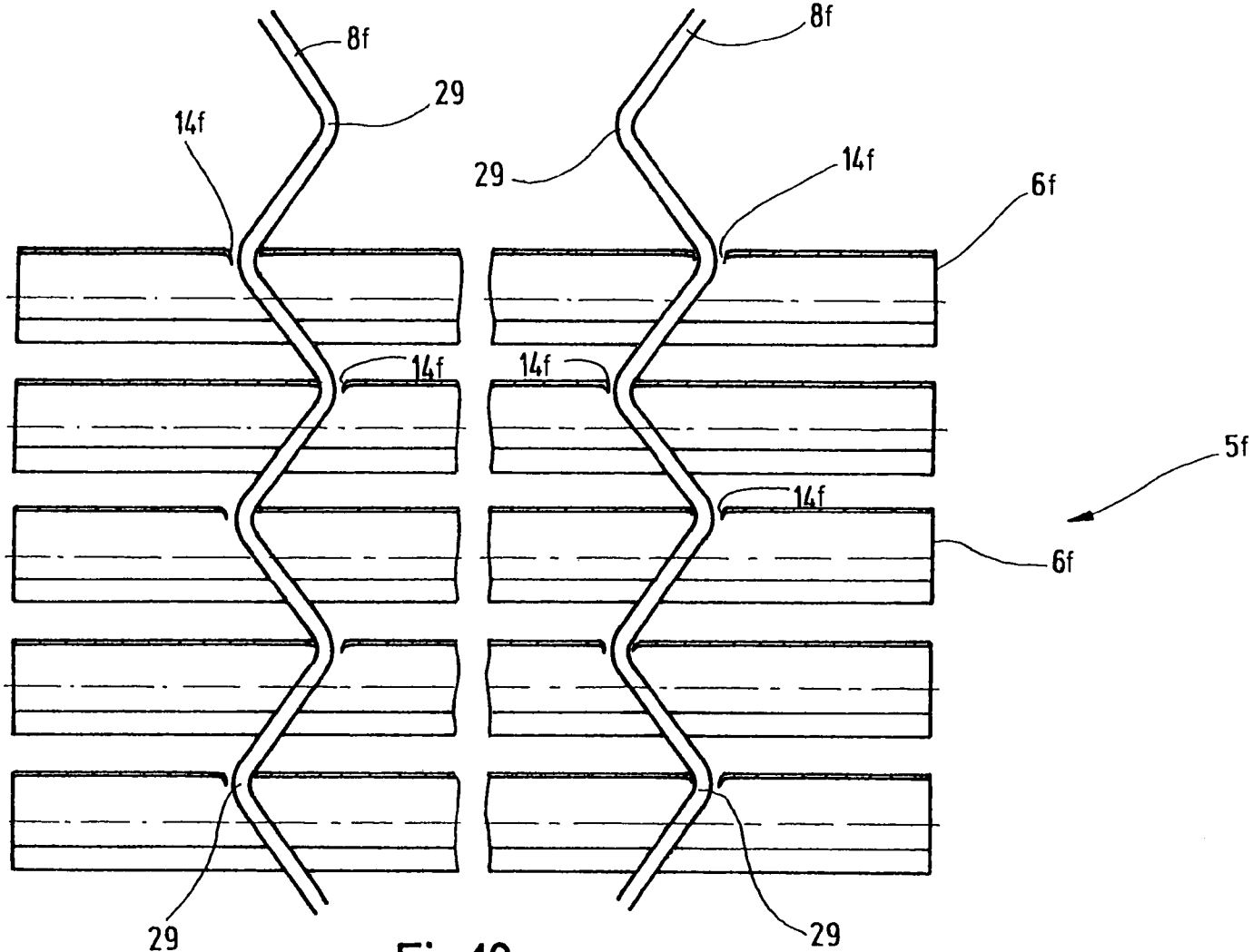

FIGS. 9 and 10 show exemplary embodiments in which once again deformation of a connecting element which extends over the length of the flat article $\mathbf{5}_e$ is employed. In FIG. 9, the connecting element $\mathbf{8}_e$ is bent in undulating fashion; the undulating course creates a shoulder 27, on which the applicable bar rests with the edge of the associated opening. The wavelength with which the connecting element $\mathbf{8}_e$ is bent in undulating fashion corresponds exactly to the spacing within the flat article; that is, the spacing of adjacent shoulders 27 corresponds to the spacing of the corresponding parts of adjacent bars $\mathbf{6}_e$.

In FIG. 9, the connecting element 8 is bent in undulating fashion; the undulating course creates a shoulder 27, on which the applicable bar rests with the edge of the associated opening. The wavelength with which the connecting element 8 is bent in undulating fashion corresponds exactly to the spacing within the flat article; that is, the spacing of adjacent shoulders 27 corresponds to the spacing of the corresponding parts of adjacent bars 6.

In the exemplary embodiment of FIG. 10, the "wavelength" is twice as great. Each connecting element $\mathbf{8}_f$ is bent in zigzag fashion, and at every turning point 29 in the course of the zigzag there is a respective opening $\mathbf{14}_f$ of a bar $\mathbf{6}_f$. So that the bars $\mathbf{6}_f$ cannot fall down, each two adjacent connecting elements $\mathbf{8}_f$ are oriented in opposite directions, so that their apexes point alternatingly toward and away from one another, as shown. Correspondingly, in successive bars $\mathbf{6}_f$, the openings $\mathbf{14}_f$ are offset by the rise of the zigzag pattern.

Correspondingly, in successive bars 6, the openings 14 are offset by the rise of the zigzag pattern.

In all the exemplary embodiments described above, the connecting elements are linear; that is, they comprise a wire. With the exception of the exemplary embodiment of FIG. 2, the material must be permanently deformable when it is bent over short radii of curvature. Conversely, the connecting element must not be deformed if it is bent over radii of curvature equivalent to the diameter of the winding roller.

In the exemplary embodiment of FIG. 2, plastic monofilaments also can be substituted as connecting elements. In all the other embodiments, metal is preferred.

The advantage of the linear or wirelike connecting elements is that the requisite openings can be created by punching with a simple needle into the relatively very thin-walled material of the bars.

Instead of the wirelike connecting elements, bandlike connecting elements $\mathbf{8}_g$, $\mathbf{8}_h$, $\mathbf{8}_i$, can also be used, as depicted in FIGS. 11–15. The bars $\mathbf{6}_g$, $\mathbf{6}_h$, $\mathbf{6}_i$, again have the cross-sectional shape described above and comprise a thin-walled roll-formed material. Opposite the slit $\mathbf{12}_g$, $\mathbf{12}_h$, $\mathbf{12}_i$, for each connecting element there are oblong slots 31, which extend with their longer axis parallel to the longitudinal axis of the applicable bar.

The bars 6 again have the cross-sectional shape described above and comprise a thin-walled roll-formed material. Opposite the slit 12, for each connecting element there are oblong slots 31, which extend with their longer axis parallel to the longitudinal axis of the applicable bar 6.

Each connecting element $\mathbf{8}_g$, $\mathbf{8}_h$, $\mathbf{8}_i$ comprises a narrow steel band, from the middle of each a tongue $\mathbf{32}_g$, $\mathbf{32}_h$, $\mathbf{32}_i$ is bent out. The tongue $\mathbf{32}_g$, $\mathbf{32}_h$, $\mathbf{32}_i$ is rectangular in shape, and in the position for use it is joined on its upper end to the rest of the band. The lower edge protrudes freely. Because of the spring elasticity in the tongue, the individual bars can be assembled on one after another. When the tongues $\mathbf{32}_g$, $\mathbf{32}_h$, $\mathbf{32}_i$ pass through the opening $\mathbf{14}_g$, $\mathbf{14}_h$, $\mathbf{14}_i$, the tongues $\mathbf{32}_g$, $\mathbf{32}_h$, $\mathbf{32}_i$ correspondingly deflect spring-elastically to the side, making it easily possible to slip on the bars.

Figure 15:
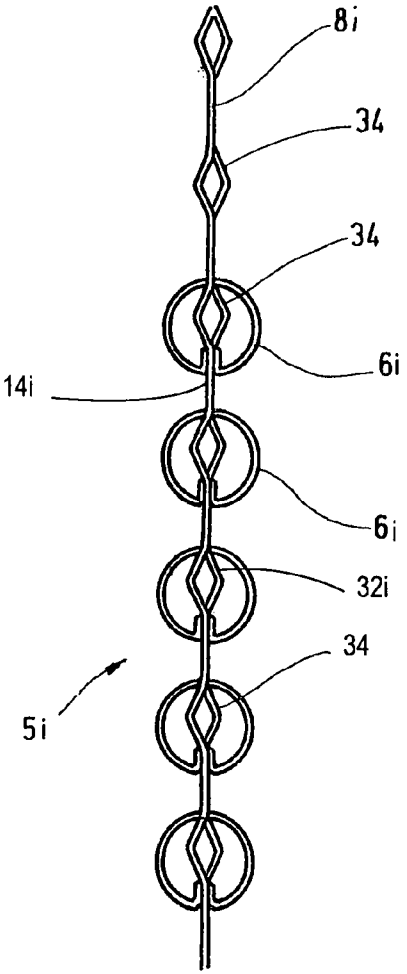
FIG. 15 is a transverse section of a further embodiment of window shade flat article according to the invention with bandlike connecting elements which have lateral portions that bulge outwardly.

In the assembled state, the free end of the tongue $\mathbf{32}_i$ as shown in FIG. 15 is located directly opposite the bent-upward edge of the slit, while the opposite back of the bar $\mathbf{6}_i$ rests on the shoulder which is formed which the tongue $\mathbf{32}_i$, after deflecting outward, returns to its position of repose. The weight of each individual bar $\mathbf{6}_i$ is too slight for the tongue $\mathbf{32}_i$ to be deflected by it and be able to pass through the opening $\mathbf{14}_i$.

The weight of each individual bar 6 is too slight for the tongue 32 to be deflected by it and be able to pass through the opening 14.

Figure 11:
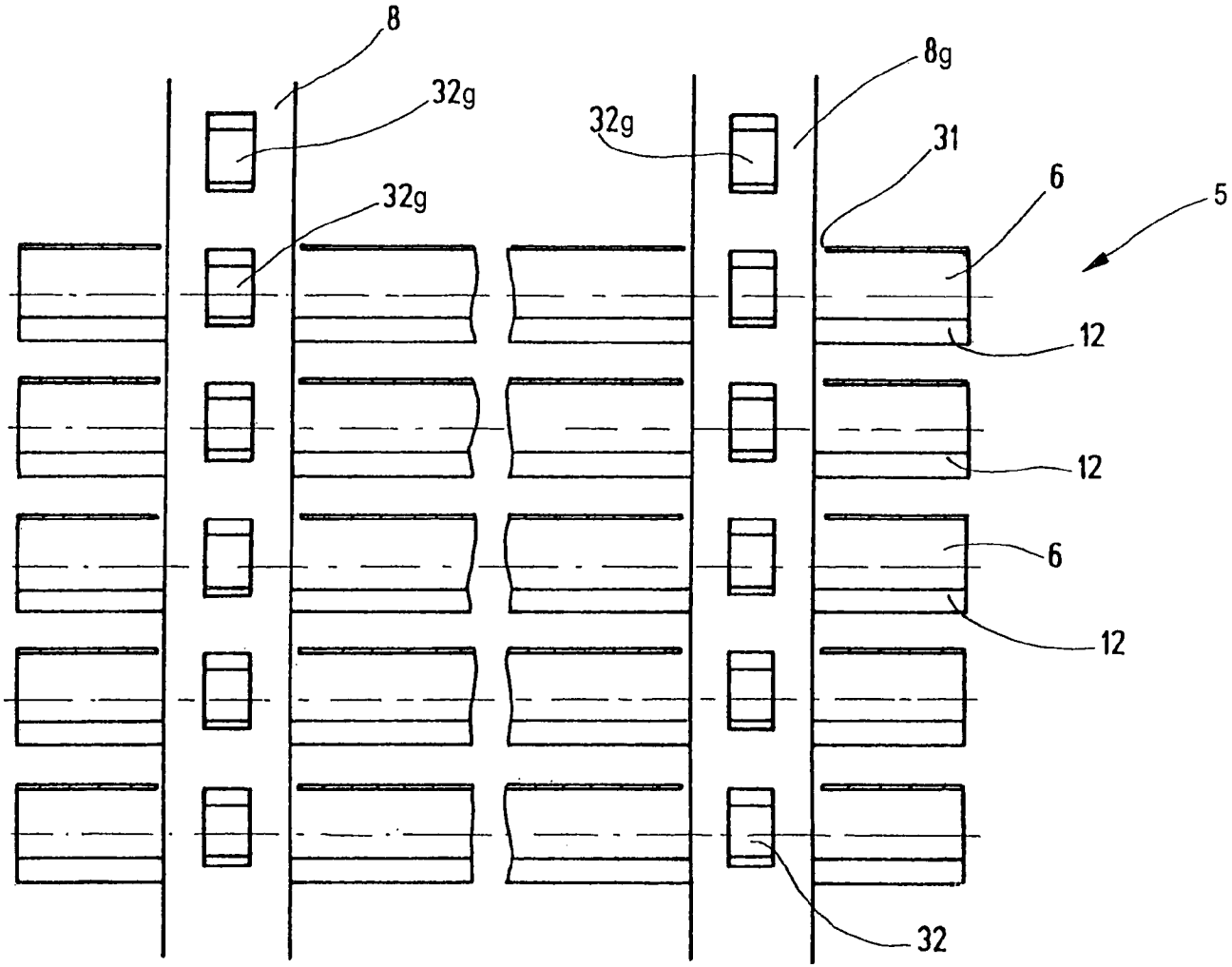
FIGS. 11 and 12 are longitudinal and transverse sections, respectively, of a window shade flat article according to the invention with bandlike connecting elements from which tongues with free ends are bent out.
Figure 12:
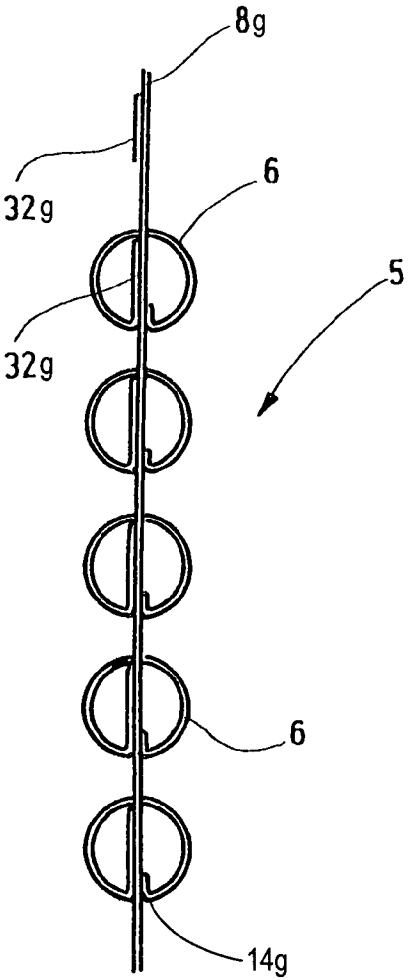
Figure 13:
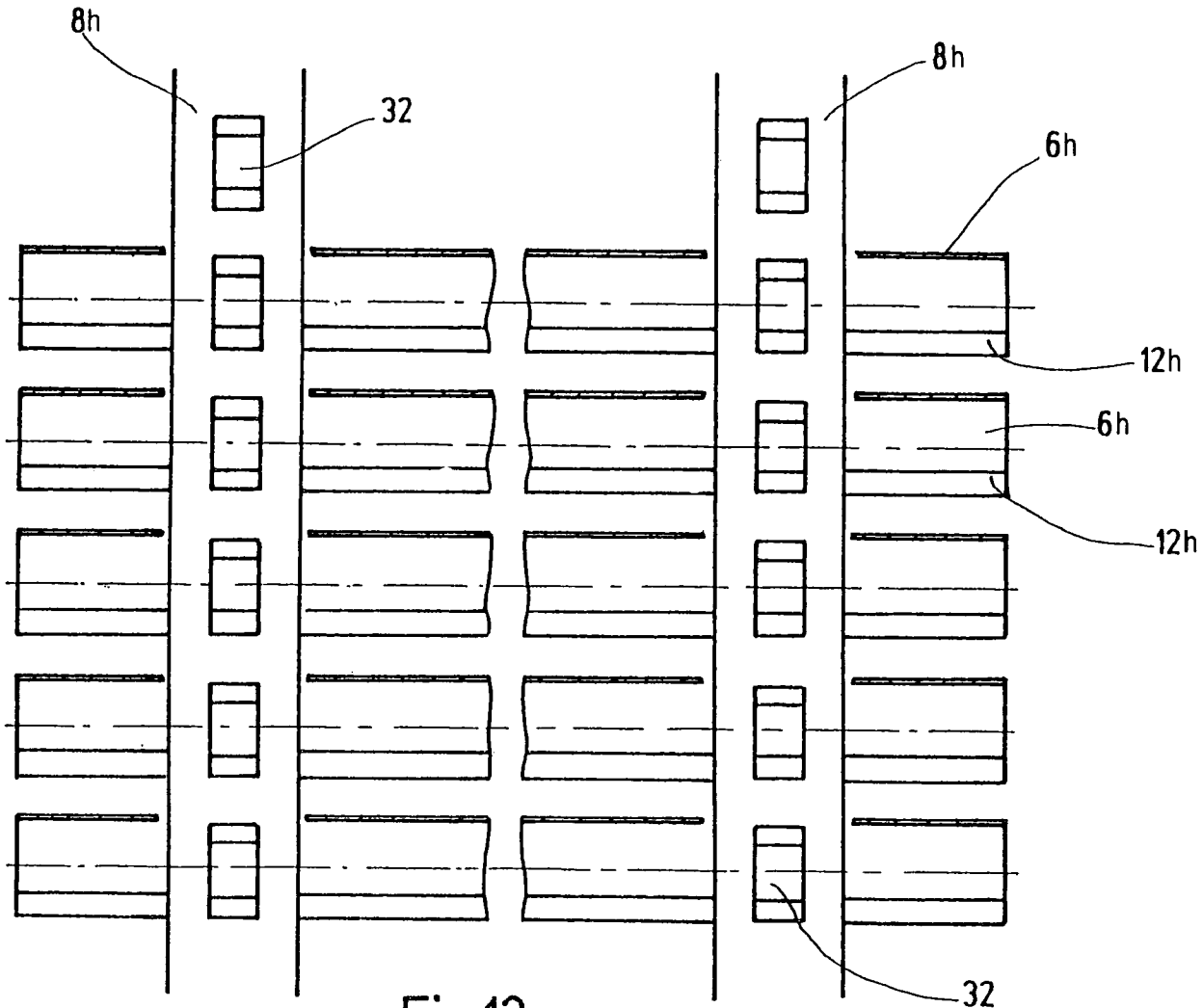
FIGS. 13 and 14 are longitudinal and transverse sections, respectively, of an alternative embodiment similar to that shown in FIGS. 11 and 12, but in which the tongues are additionally bent at an angle.
Figure 14:
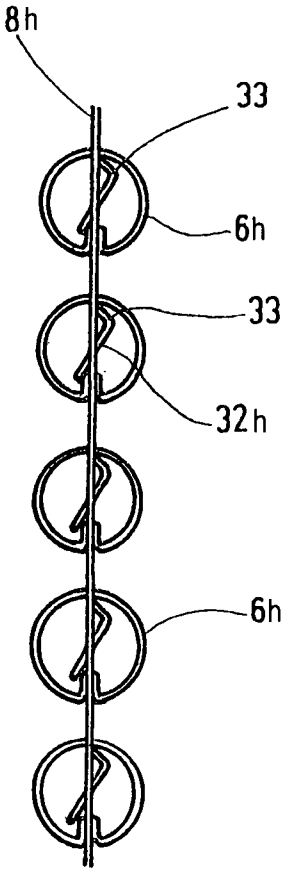

FIGS. 13 and 14 show an embodiment similar to that of FIGS. 11 and 12, but with the distinction that the tongue 32 is additionally bent approximately into an L. In this way, a shoulder 33 is created that is more sharply pronounced than in the exemplary embodiment of FIGS. 11 and 12.

The tongue 32 is moreover bent out of the material in such a way that, as FIG. 14 shows, it pierces the plane defined by the band.

FIG. 15, finally, shows an embodiment in which bending out the tab creates a feature 34 that bulges outwardly; the bending out is done in such a way that no free ends in the longitudinal direction of the band are created.

The flat article of the invention can be used not only in shades and comparable shading devices, but also can be used to vary the acoustics of a room or to achieve particular visual effects.

If the flat article is used for shading purposes, it can be modified for that purpose such that spacing between the individual bars 6 varies along the flat article.

Figure 16:
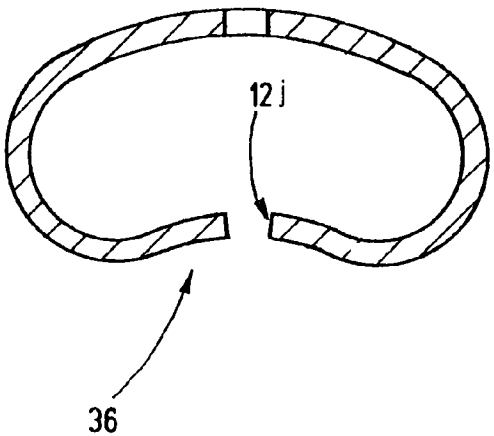
FIG. 16 is a transverse section of an alternative form of bar for the flat article of the invention.

In order to largely preclude interfering reflections when sun shines in, the bars can also have the kidney-shaped cross-sectional form shown in FIG. 16. In this embodiment, the side that is at the bottom during use, which optionally also includes the slit $\mathbf{12}_i$, is provided with a continuous concave groove 36 over the length. The highly reflective top side of a bar located beneath it casts incident light into the region of this groove 36, which in turn, because of its location, predominantly reflects the light back toward the side from which the light originally fell onto the flat structure.

Figure 18:
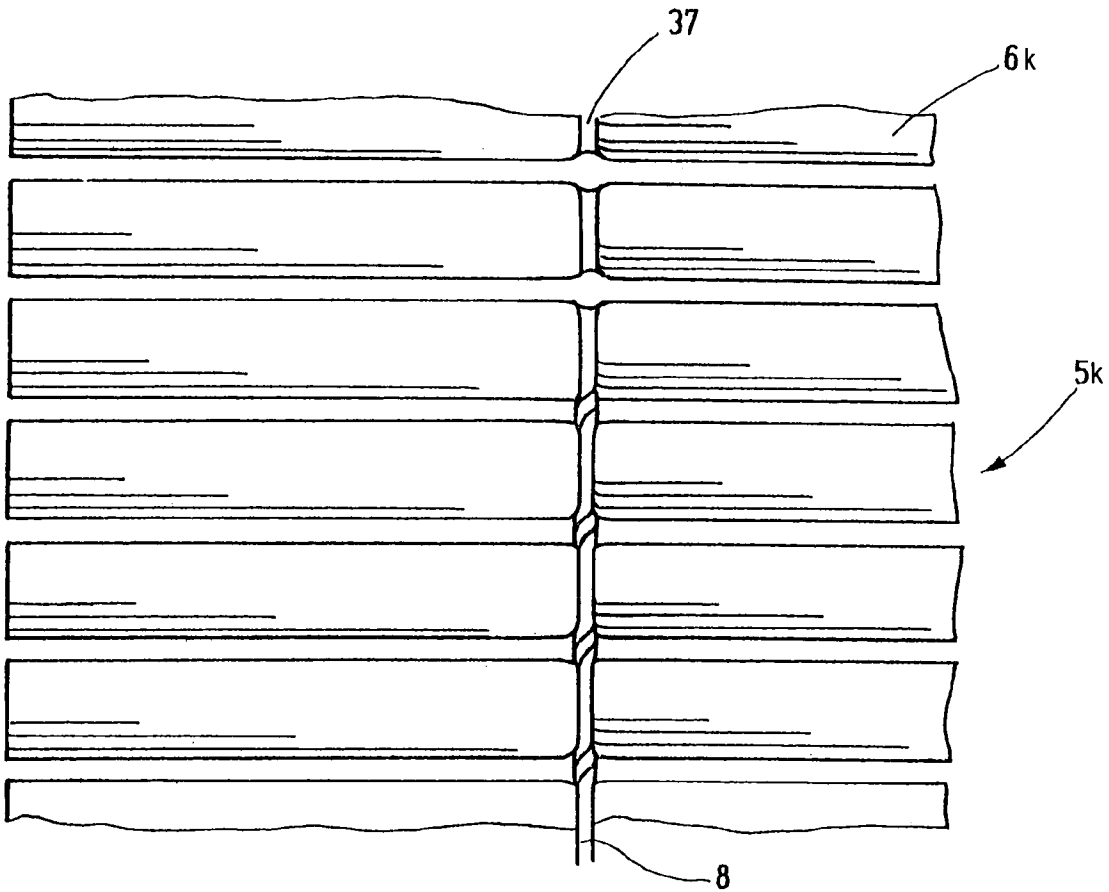
FIGS. 17 and 18 are longitudinal and transverse sections, respectively, of an alternative embodiment of flat article according to the invention with connecting elements that extend along the outside of the bars.
Figure 17:
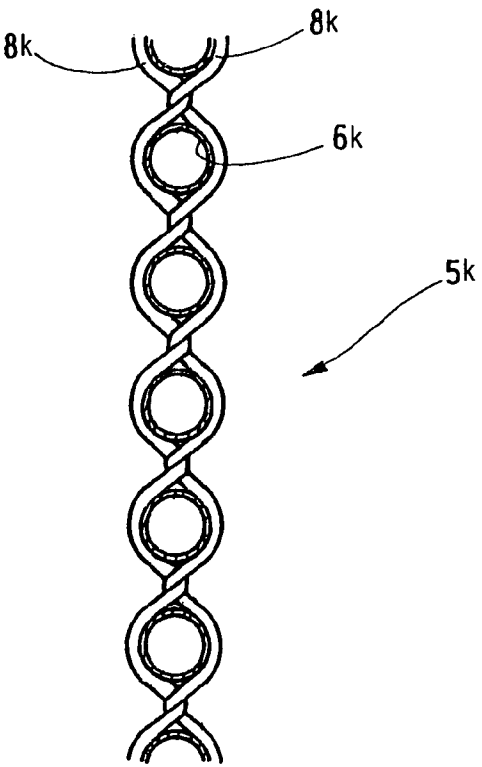

In the exemplary embodiments described above, the connecting element 8 extends through each respective bar. However, it is possible to create a flat article $\mathbf{5}_k$ in which the connecting element $\mathbf{8}_k$ extends on the outside, around the bar $\mathbf{6}_k$, such as shown in FIGS. 17 and 18.

Where each of the bars $\mathbf{6}_k$ is engaged by the connecting means $\mathbf{7}_k$, the bars are provided with an encompassing groove 37. The connecting elements $\mathbf{8}_k$ are once again steel wires; specifically, two steel wires or in other words two connecting elements $\mathbf{8}_k$ per connecting point are used. The wirelike connecting elements 8 pass on both sides of the flat structure $\mathbf{5}_k$ through the grooves 37 and between two adjacent bars are twisted once or multiple times together, as shown. The length of the twisted portion defines the spacing that adjacent bars 6 have from one another.

With the aid of the groove 27, it is assured that the bars 6 cannot be displaced axially in the loop, each loop being formed by one pair of connecting elements $\mathbf{8}_k$, that extends between two twisted portions.

Figure 21:
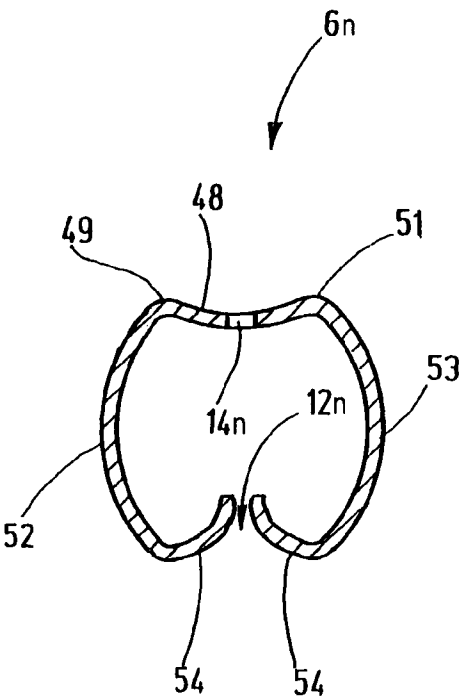
FIGS. 19–21 are transverse sections of alternative forms of the bars that can be utilized in the flat article of FIG. 1.
Figure 20:
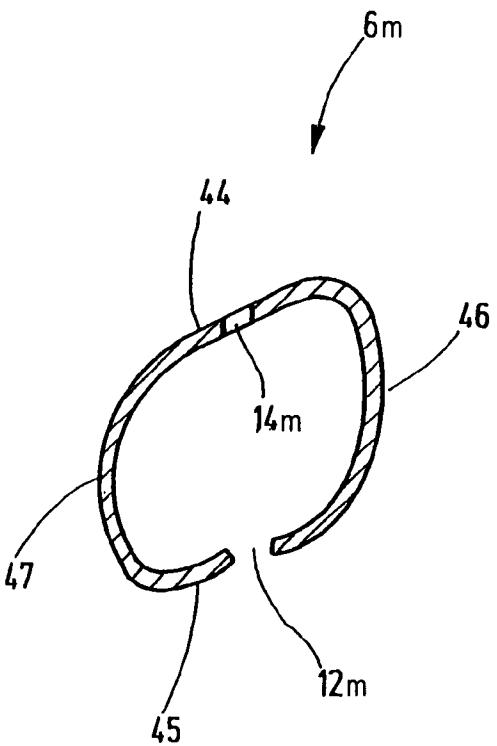
Figure 19:
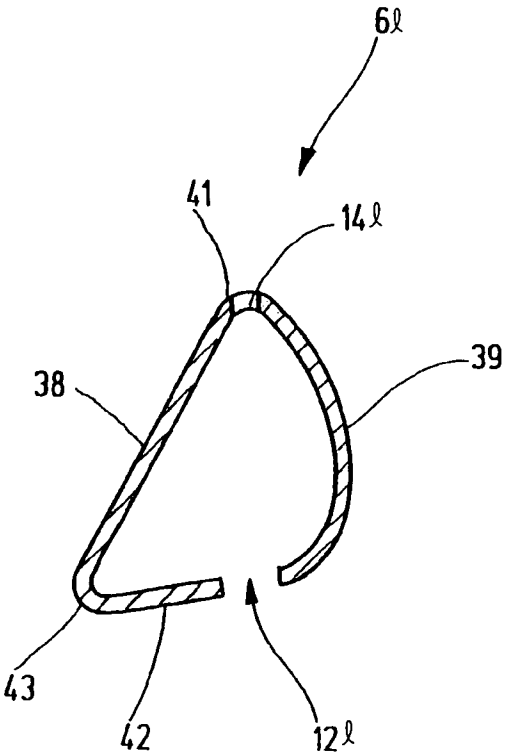

FIGS. 19, 20 and 21 show further cross-sectional profiles for the bar, which are suitable for reducing the passage of light between adjacent bars by way of reflection from the surface. In the cross-sectional profile of FIG. 19, the bar 6 has a flattened side 38, which is essentially straight. This flat side 38, which extends over the length of the bar 6, extends at an acute angle to the imaginary connecting straight line through the hole $\mathbf{14}_l$ and the slit $\mathbf{12}_l$ aligned with it.

On the side opposite the flat side 38, the cross-sectional profile is curved in an arc at 39. At an apex 41, this profiled portion 39 merges with the flat side 38. The holes $\mathbf{14}_l$ are contained in the apex 41.

On the lower end, the region 39 extends as far as the slit $\mathbf{12}_l$. On the other side of the slit $\mathbf{12}_l$, the profile also has a straight portion 42, which at an edge 43 changes over with a slight radius to the flat side 38.

The cross-sectional profile of FIG. 20 is designed such that a flattened profiled portion 44 is provided on the top side of the bar $\mathbf{6}_m$. This flattened and approximately straight region 44 extends at an oblique angle to an imaginary axis that is defined by the holes $\mathbf{14}_m$ and the slit $\mathbf{12}_m$ opposite them.

A flattened region 45 also exists on either side of the slit $\mathbf{12}_m$ and is approximately parallel to the flattened region 44. The two flattened regions 44 and 45 are each joined together by partially cylindrical portions 46 and 47; the radius of curvature is greater than the spacing between the two flattened regions 44 and 45.

Finally, FIG. 21 shows a cross-sectional profile in which the bar $\mathbf{6}_n$ is embodied as concave in groovelike fashion on its top side, where the holes $\mathbf{14}_n$ are located. The result is a groovelike region 48, which at bending edges 49, 51 changes over into partially cylindrical curved regions 52, 53. The radius of curvature of the partially cylindrical faces 52, 53 is greater than the diameter or height of the bar $\mathbf{6}_n$, measured in the profile of FIG. 21 along a vertical line.

The lower side of the bar $\mathbf{6}_n$ also is shaped in groovelike fashion; that is, two surface regions 54, 55, which are located beside the slit $\mathbf{12}_n$ and include the lower edges of the regions 52 and 53, are bent upward toward the inside; that is, the edges of their slit point upward to a certain degree.

Figure 22:
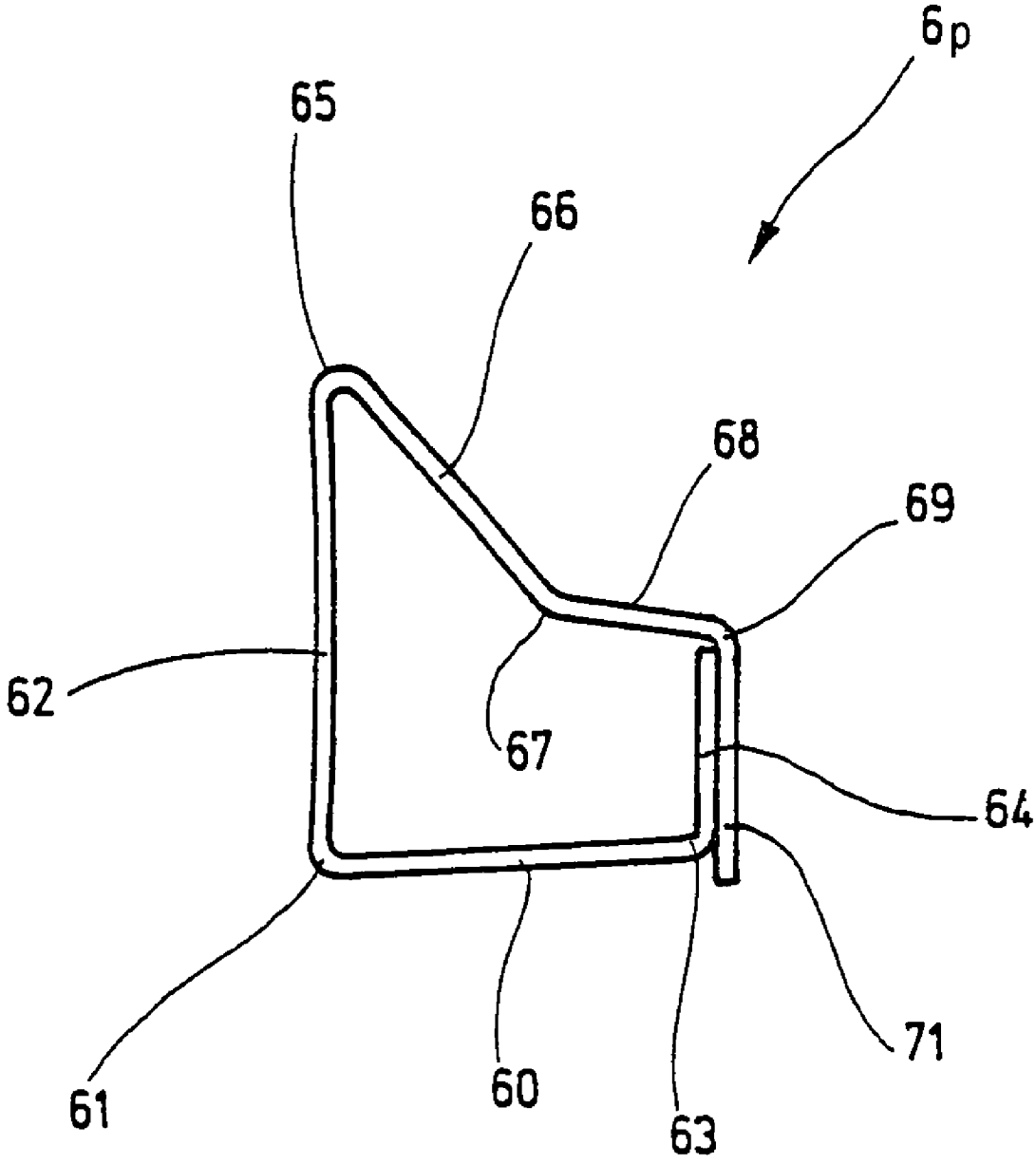
FIG. 22 is a transverse section still another alternative embodiment of a bar that can be used with the flat article depicted in FIG. 1.

FIG. 22 shows a further alternative profile for the bars. The bar $\mathbf{6}_p$ in this case comprises a special-steel tube that is pentagonal in cross section and is closed, but not seamless, in the circumferential direction. Over their length, the bars $\mathbf{6}_p$ have a constant cross section.

Instead of special steel for the bars, plastic or aluminum can also be considered. It is possible to produce the bars from suitable bands by roll forming. Brass or bronze can also be considered as materials. The surface of the bars can be satin-finished, matte-finished or shiny in either some portions or overall, depending on the visual effect to be attained.

The surface of the bars 6 can be satin-finished, matte-finished or shiny in either some portions or overall, depending on the visual effect to be attained.

The bar 6 as depicted in FIG. 22, has an underside 60 that is continuously straight over its length. The underside 60 changes over at a straight edge 61 into a back side 62, which may be straight or provided with a slight concave curvature. The latter is intended to promote winding up on the winding roller 2.

On an opposed edge 63, the underside 60 continues in the form of a straight flange 64. As the drawing shows, the height of the flange 64 makes up approximately half of the back side 62. The flange 64 and the back side 62 extend parallel and at a spacing from one another. If the back 62 is disposed vertically, the underside 60 extends at an angle of 86° to a plane defined by the back wall 62, or in other words, the underside 60 rises by approximately 4° in the direction of the flange 64.

The back side 62 ends at an edge 65, where the profile of the bar changes over into a face 66. The face 66 is a straight face with an angle to the horizontal of approximately 50°, that is, a perpendicular to the plane defined by the back side 62. At a sharp bend 67, the face 66 changes over into a face 68, which is likewise a straight face.

With respect to the aforementioned horizontal defined, the face 68 is inclined downward by approximately 7° in the direction of an edge 69, where the material of the profile is bent downward vertically, forming a further flange 71. The two flanges 79 and 64 rest flatly on one another, resulting in the aforementioned intrinsically closed but not seamless profile. The two flanges 71 and 64 rest loosely on one another. The two faces 66 and 68 form a groove pointing upward.

Because of the angles given, the angle bisector between the two faces 66 and 68 points upward at an angle of approximately 26°, measured as the angle between the angle bisector and the plane defined by the back side 32.

The thickness of the bar $\mathbf{6}_p$, measured from the back side 62 to the outside of the flange 71, is approximately 4 mm, and the spacing of the two edges 61 and 65 from one another is approximately 5 mm. It can also be seen from FIG. 22 that the flange 71 protrudes downward some distance past the edge 63. Because of this protrusion, a straight line which touches the lowermost point of the edge 61 and the free edge of the flange 71 extends at an angle of approximately 90° relative to the back side 62.

It can also be seen from FIG. 22 that the flange 71 protrudes downward some distance past the edge 63. Because of this protrusion, a straight line which touches the lowermost point of the edge 61 and the free edge of the flange 71 extends at an angle of approximately 90° relative to the back side 62.

If the flat article is assembled from bars $\mathbf{6}_p$ having the profile of FIG. 22, specifically with a spacing of approximately 1.5 to 2 mm, measured between the edge 65 and the edge 61 of each of two adjacent bars $\mathbf{6}_p$, no vertically lighted band can be observed on the inside, as long as the sun is higher than approximately 25° above the horizon. To achieve this goal, the faces 66, 68 inclined toward one another are oriented toward the sun, while the back side 62 points into the interior of the room.

Figure 23:
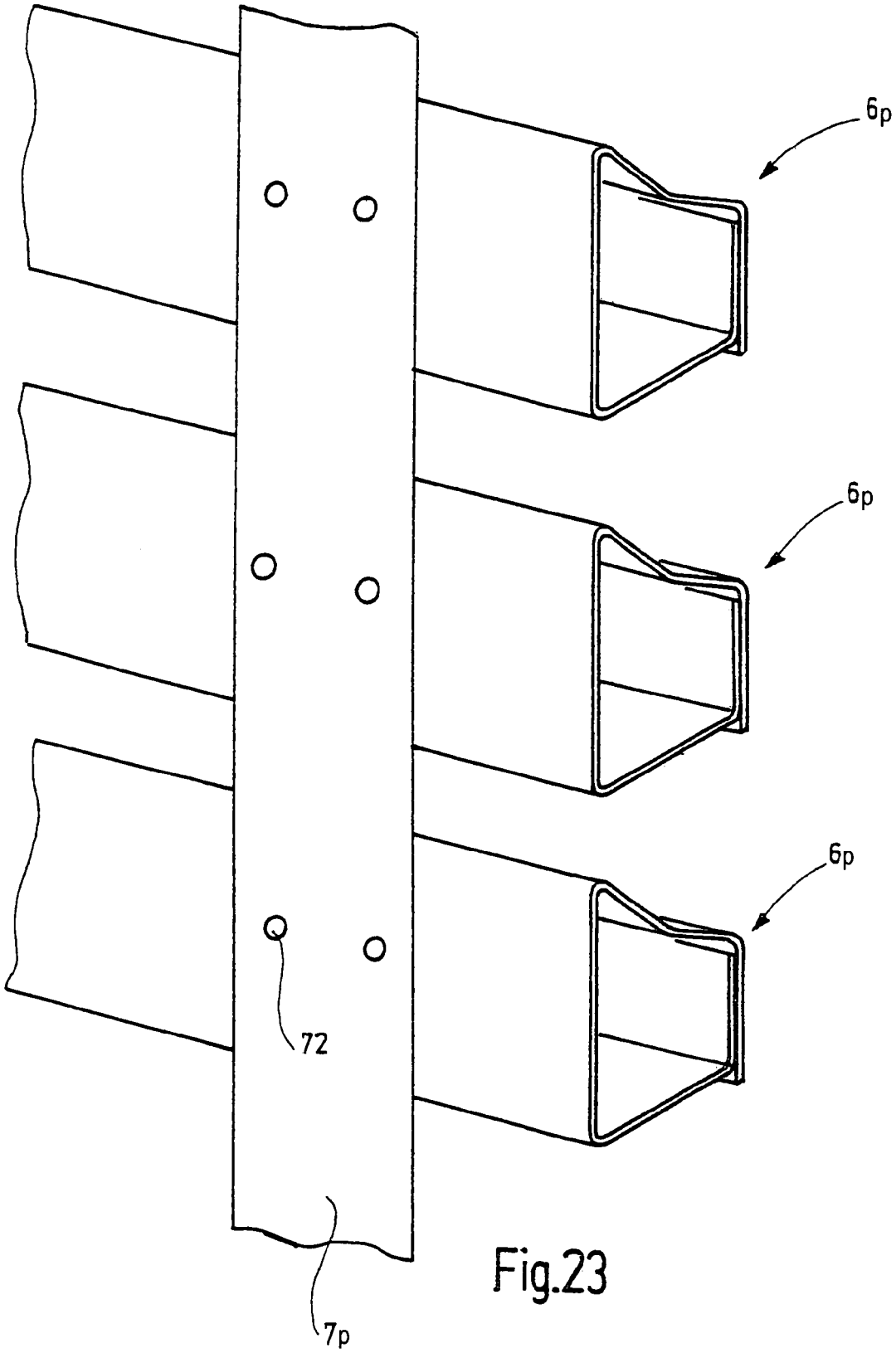
FIG. 23 is a fragmentary rear perspective showing the attachment of bars of the type shown in FIG. 22 to a connecting means.

FIG. 23 illustrates the connection of the bars $\mathbf{6}_p$ of FIG. 22 to a connecting means $\mathbf{7}_p$. The connecting means $\mathbf{7}_p$ are two or more thin steel bands, to which the bars $\mathbf{6}_p$ are welded by their back side 62, with the aid of one or two laser spot welds 72. The laser spot welds 72 are shown schematically in FIG. 23. In actuality, they are practically invisible in the finished product. The laser spot welds 72 are expediently located at the same height, so that winding up of the flat article 5 onto the winding roller 2 is unhindered. Instead of spot-welding the bars $\mathbf{6}_p$ to the bandlike connecting means 7, they can be adhesively bonded to the bandlike connecting means over the height of the face 62.

The laser spot welds 72 are expediently located at the same height, so that winding up of the flat article 5 onto the winding roller 2 is unhindered.

Instead of spot-welding the bars 6 to the bandlike connecting means 7, they can be adhesively bonded to the bandlike connecting means over the height of the face 62.

Figure 24:
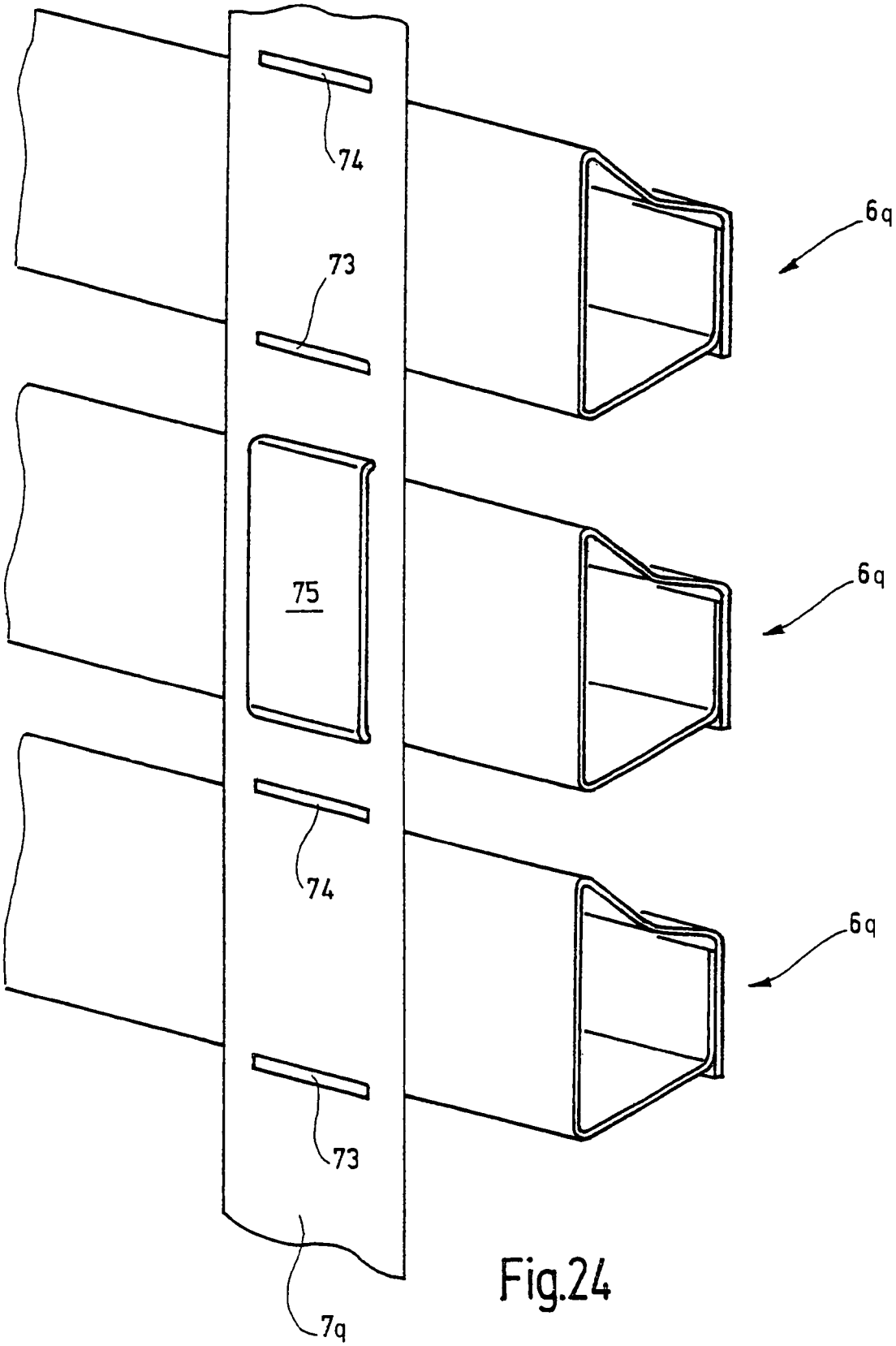
FIG. 24 is a rear perspective of a further exemplary embodiment in which bars of the type shown in FIG. 22 are connected to a connecting means with clamps.

FIG. 24 shows a further possible way of fastening the bars to a bandlike connecting means $\mathbf{7}_q$. To that end, the applicable band is provided with pairs of slits 73, 74. The spacing of the two slits 73, 74 of a pair from one another is equivalent to the spacing between the edges 61 and 65 of the applicable bar 6. The spacing of the pairs of these slits 73,74 from the next pair is selected such that the desired gap between adjacent bars $\mathbf{6}_q$ is created.

Figure 25:
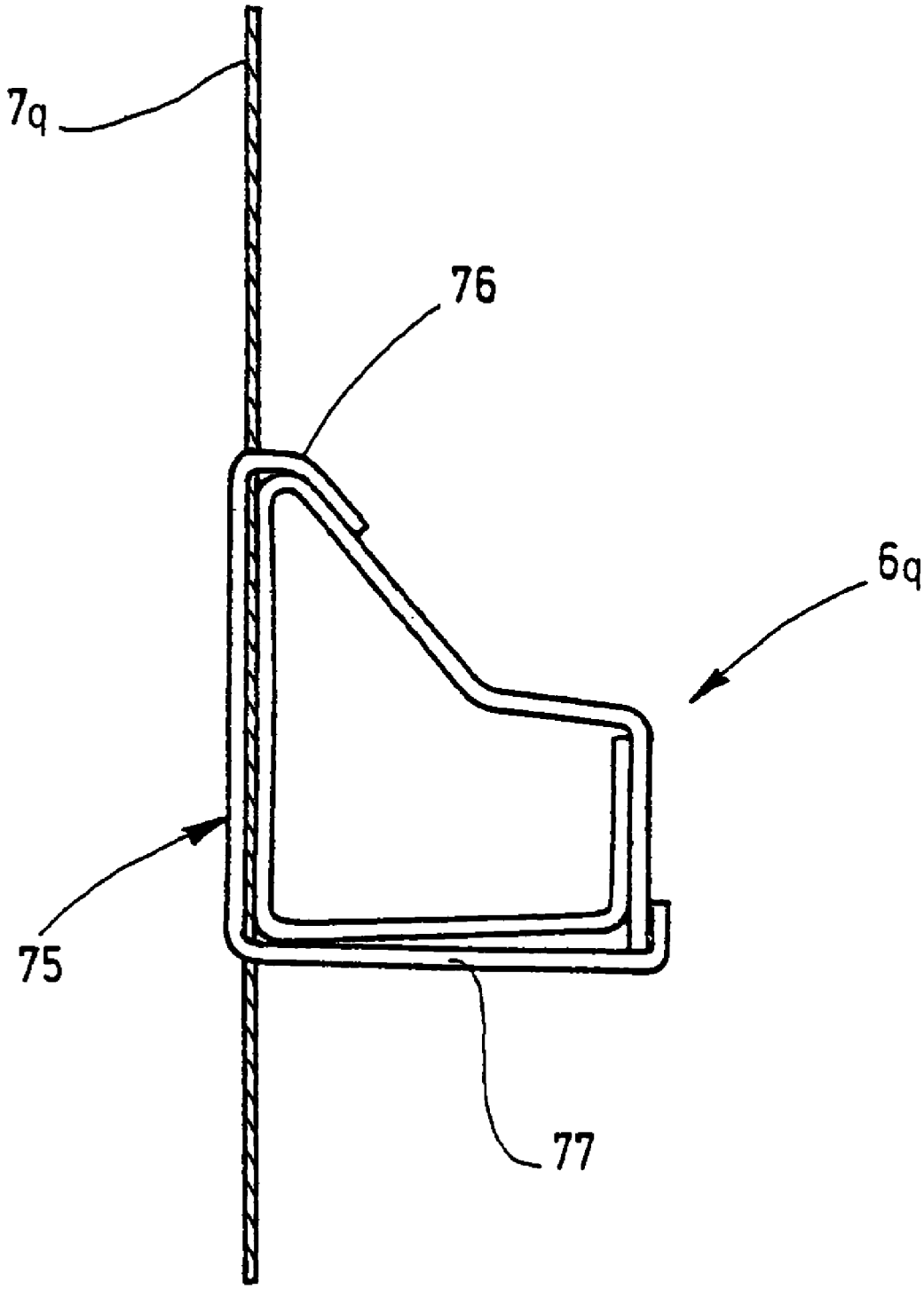
FIG. 25 is a transverse section of the bars and connecting means shown in FIG. 24.

Through each pair of slits 73, 74, which are located transversely to the longitudinal direction of the band $\mathbf{7}_q$, a clamp 75 is inserted having legs 76 and 77. The legs 76, 77 are bent over on the front side with the bars $\mathbf{6}_q$, as shown in FIG. 25, in order to hold the bar 6 firmly on the connecting means 7.

Figure 26:
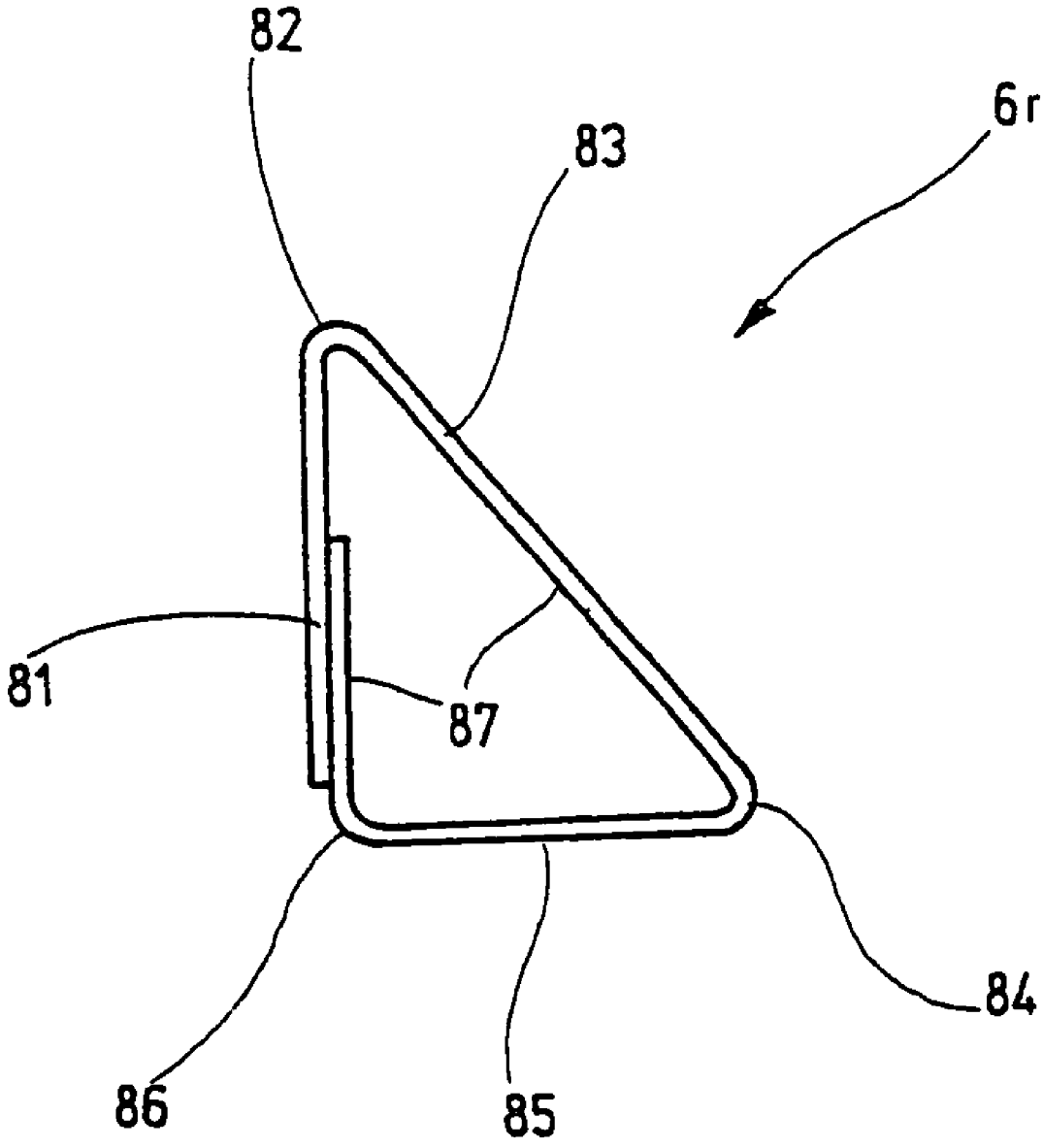
FIG. 26 is a transverse section of a further alternative embodiment of bar that can be used with the window shade flat article shown in FIG. 1.

FIG. 26, finally, shows a triangular cross-sectional profile for a bar $\mathbf{6}_r$ which can be joined together to form the flat article $\mathbf{5}_r$. The bar $\mathbf{6}_r$ of FIG. 26 is again produced as a roll-formed profile. The cross-sectional profile has a back face 81, which changes over at 82 into a front face 83. The front face 83 ends at a bending edge 84. There, the cross-sectional profile changes over into an underside 85, which ends at a back bending edge 86. This is adjoined by an upward-pointing ledge 87, which rests from the inside on the back face 81. The angle that the face 83 forms to a normal to the flat article is equivalent to the angle that the face 66 of the profile of FIG. 22 forms with the same normal. The inclination of the face 83 is equivalent to the inclination of the face 60. The angle that the face 83 forms to a normal to the flat article is equivalent to the angle that the face 66 of the profile of FIG. 22 forms with the same normal.

The inclination of the face 83 is equivalent to the inclination of the face 60.

Instead of providing the overlap in the back region, the overlap can also be provided in the region of the bending edge 84. In that case it is similar to the arrangement shown in FIG. 22, with the distinction that the ledge 64 present there extends on the inside of the face 83 and parallel to it.

It can be seen that the illustrated bar profiles not only can be used for flat articles that can be wound up but also for a rigid flat article. For that purpose it suffices if the connecting bands are made rigid. Finally, it can be seen that the length dimensions given above also can be increased proportionately, for instance in order to create a light-protection means that is permanently in place in front of an opening such as a window where light enters. For that purpose, the length dimensions of the bars can be increased accordingly. For edge lengths, for instance, values of 4 to 5 cm can be provided, instead of 4 and 5 mm as given above. Still greater enlargements of the profile are equally possible. If the profile dimensions of the bars are relatively large, seamless extruded profile sections can also be used.

In all cases, the width of the gap between adjacent bars is between 25% and 100% of the diameter of each bar. The smaller the spacing, the lower the angle of the sun above the horizon at which it shines directly through.

The bars in this way can then readily be mounted individually in front of the applicable opening. It is important only that the angles given be at least approximately adhered to. So that enough light can pass through, the spacing between the individual bars should be increased or decreased in accordance with the changes in the length dimensions From the foregoing, it can be seen that a flat article is provided that comprises bars extending parallel to one another in spaced-apart fashion, which are joined together by connecting means. The connecting means can be designed such that they extend over the full length of the flat article, or alternatively they can each join together only two immediately adjacent bars A bar for a sun shading or light shading device has an essentially pentagonal profile, and on the side toward the light the profile is provided with an obliquely upward-pointing groove. The groove is defined by two straight faces, inclined and an angle of approximately 134° to one another, extending through the length of the bar.

The invention claimed is:

1. An apparatus comprising:

a plurality of roll formed elongated bars (6) which each have a hollow cross sectional profile; said bars being flattened on at least elongated side; connecting elements (7) in the form of at least two laterally spaced continuous flexible strips holding said bars (6) together to form a flat article; said bars (6) being held by said connecting elements (7) in parallel spaced apart relation to each other with gaps between adjacent bars (6) effective for regulating the passage of light through the flat article; and said flat article being flexible about axes parallel to said bars (6).

2. The apparatus of claim 1 in which said bars are made of plastic.

3. The apparatus of claim 1 in which said bars are made of metal.

4. The apparatus of claim 1 in which said bars (6) are continuously hollow.

5. The apparatus of claim 1 in which said bars (6) have a continuously constant cross section.

6. The apparatus of claim 1 in which said bars (6) have a nonoxidizing outer surface.

7. The apparatus of claim 6 in which said bars (6) have nonoxidizing coating.

8. The apparatus of claim 1 in which said bars (6) each are flattened in cross section on one side (38) facing said connecting element strips.

9. The apparatus of claim 1 in which said bars (6) are concave on at least one side (48,54).

10. The apparatus of claim 1 in which said bars (6) are straight.

11. The apparatus of claim 1 in which bars (6) have a matte finished outside surface.

12. The apparatus of claim 1 which said bars (6) are connected to the connecting elements (8) without displacement of the bars (6) in a longitudinal direction relative to the connecting elements (8).

13. The apparatus of claim 1 in which at least some of the bars (6) have a continuous outside surface which points upward in a direction of between 25° and 80° relative to the vertical.

14. The apparatus of claim 1 in which at least some of the bars (6) have a continuous outside surface which points upward in a direction of about 50° relative to the vertical.

15. The apparatus of claim 1 in which at least some of the bars (6) have a continuous groove (66,68) on an outside which points upward in the direction of between 10° and 40° relative to the vertical.

16. The apparatus of claim 1 in which at least some of the bars (6) have a continuous groove (66,68) on an outside which points upward in the direction of about 26° relative to the vertical.

17. The apparatus of claim 16 in which said groove is defined by two substantially flat faces (66,68) which form an angle of between 165° and 120°.

18. The apparatus of claim 16 in which the groove is defined by two substantially flat faces (66,68) which form an angle of about 137°.

19. The apparatus of claim 18, in which a bisector of the angle that the two faces (66,68) of the groove form with one another extends at an angle of approximately 26° relative to a plane defined by the flat article (5).

20. The apparatus of claim 1 in which the cross-sectional profile of the bars is pentagonal.

21. The apparatus of claim 20 in which said bars have two sides (62,64) of the cross-sectional profile that extend parallel to one another.

22. The apparatus of claim 21 in which said bars have one side (60), located between the sides (62,64) that are parallel to one another, that forms an angle of 86° with respect to one of the parallel sides.

23. The apparatus of claim 22 in which said bars have two side faces (66,68) located between the two sides (62,64) that are parallel to one another.

24. The apparatus of claim 1 in which each said bar (6) is edge-rolled with two straight flanges (64,71) which overlap one another flatly.

25. The apparatus of claim 24 in which one of said flanges (71) forms an edge located on the outside which protrudes past an adjacent side (60) of the bar (6).

26. The apparatus of claim 1 in which said bars are connected to the connecting elements (8) by laser weldments.

27. The apparatus of claim 1 in which said bars are connected to the connecting elements (8) by an adhesive.

28. The apparatus of claim 1 in which the flat article is part of a shading device.

29. The apparatus of claim 1 in which the flat article forms a wall covering.

30. The apparatus of claim 1 in which said bars are flattened on an elongated side facing said connecting element strips.

31. The apparatus of claim 9 to which said bars are concave on at least one side that faces an adjacent bar.

* * * * *